US010556642B1

(12) United States Patent
Massicotte et al.

(10) Patent No.: US 10,556,642 B1
(45) Date of Patent: Feb. 11, 2020

(54) WATERCRAFT

(71) Applicant: BOMBARDIER RECREATIONAL PRODUCTS INC., Valcourt (CA)

(72) Inventors: Alain Massicotte, Sherbrooke (CA); Rick Adamczyk, St. Cloud, FL (US)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 0 days.

(21) Appl. No.: 16/007,292

(22) Filed: Jun. 13, 2018

Related U.S. Application Data

(63) Continuation of application No. 15/338,998, filed on Oct. 31, 2016, now abandoned.

(60) Provisional application No. 62/248,522, filed on Oct. 30, 2015.

(51) Int. Cl.

| | |
|---|---|
| ***B63H 11/113*** | (2006.01) |
| ***B63B 1/12*** | (2006.01) |
| ***B63B 3/48*** | (2006.01) |
| ***B63H 25/46*** | (2006.01) |
| ***B63B 17/00*** | (2006.01) |
| ***B63H 11/04*** | (2006.01) |
| ***B63B 3/38*** | (2006.01) |

(52) U.S. Cl.
CPC ..... *B63B 1/125* (2013.01); *B63B 3/38* (2013.01); *B63B 3/48* (2013.01); *B63B 17/0027* (2013.01); *B63H 11/04* (2013.01); *B63H 25/46* (2013.01); *B63B 2751/00* (2013.01)

(58) Field of Classification Search
CPC .. B63B 1/10; B63B 1/12; B63B 1/125; B63B 2001/10; B63B 2001/12; B63B 2110/125; B63B 3/38; B63B 3/48; B63B 2003/38; B63B 2003/48; B63B 17/0027; B63B 2751/00; B63H 11/00; B63H 11/02; B63H 11/04; B63H 11/08; B63H 11/10; B63H 11/101; B63H 11/102; B63H 11/103; B63H 11/107; B63H 11/113; B63H 11/114; B63H 25/46; B63H 2011/00; B63H 2011/008; B63H 2011/02; B63H 2011/04; B63H 2011/08; B63H 2011/081; B63H 2025/46; B63H 2025/465
USPC .... 114/55.5, 55.52, 55.54, 61.1, 61.14, 61.2, 114/61.22, 61.32, 271, 288, 290, 292
See application file for complete search history.

(56) References Cited

U.S. PATENT DOCUMENTS

| | | | |
|---|---|---|---|
| 2,585,599 | A | 2/1952 | Tehetchet |
| 2,991,746 | A | 7/1961 | Cunningham |
| 3,316,873 | A | 5/1967 | Dismukes |
| 3,601,077 | A | 8/1971 | Valenza, Jr. |
| 3,661,108 | A | 5/1972 | Sorenson |

(Continued)

*Primary Examiner* — Daniel V Venne
(74) *Attorney, Agent, or Firm* — BCF LLP

(57) ABSTRACT

A watercraft has a deck; central, left and right pods connected to a bottom of the deck; and a helm assembly disposed on the deck. The central pod is laterally centered relative to the deck. The central pod has a central hull defining a central tunnel, a motor connected to and disposed at least in part in the central hull, and a jet propulsion system disposed at least in part in the tunnel and operatively connected to the motor. The left pod is disposed at a left of the central pod and is laterally spaced from the central pod. The left pod has a left hull that is narrower than the central hull. The right pod is disposed at a right of the central pod and is laterally spaced from the central pod. The right pod has a right hull that is narrower than the central hull.

19 Claims, 39 Drawing Sheets

(56) References Cited

U.S. PATENT DOCUMENTS

| | | | | |
|---|---|---|---|---|
| 3,970,025 | A | 7/1976 | Sovia et al. | |
| 4,924,797 | A * | 5/1990 | Solia | B63B 1/20 114/283 |
| 5,619,944 | A * | 4/1997 | Baker | B63B 1/042 114/283 |
| 5,676,087 | A * | 10/1997 | Baker | B63B 1/042 114/283 |
| 6,546,890 | B1 * | 4/2003 | Craig | B63B 1/20 114/283 |
| 6,988,456 | B1 | 1/2006 | Schooler | |
| 7,143,710 | B2 * | 12/2006 | Lang | B63B 1/18 114/278 |
| 7,185,599 | B1 | 3/2007 | Griffiths et al. | |
| 7,418,915 | B2 | 9/2008 | Campbell | |
| 8,186,291 | B1 | 5/2012 | Curtis | |
| 8,833,284 | B1 | 9/2014 | Resta | |
| 9,038,561 | B2 | 5/2015 | Loui et al. | |
| 9,114,853 | B1 | 8/2015 | Apple et al. | |
| 9,475,548 | B1 | 10/2016 | Slocum | |
| 2003/0154896 | A1 | 8/2003 | Schmidt | |
| 2004/0168623 | A1 | 9/2004 | Kirk | |
| 2005/0126464 | A1 * | 6/2005 | Lang | B63B 1/18 114/67 A |
| 2007/0039534 | A1 | 2/2007 | Reilly et al. | |
| 2007/0039535 | A1 | 2/2007 | Reilly et al. | |
| 2007/0056496 | A1 | 3/2007 | Hodgson | |
| 2009/0227159 | A1 | 9/2009 | Meyer | |
| 2012/0024211 | A1 * | 2/2012 | Wiltse | B63B 1/14 114/39.21 |
| 2012/0164896 | A1 | 6/2012 | Kobayashi et al. | |

* cited by examiner

WATERCRAFT

CROSS-REFERENCE

The present application is a continuation application of U.S. patent application Ser. No. 15/338,998, filed Oct. 31, 2016, now abandoned, which claims priority to U.S. Provisional Application No. 62/248,522, filed Oct. 30, 2015, the entirety of both of which is incorporated herein by reference.

FIELD OF TECHNOLOGY

The present technology relates to watercraft, and more specifically watercraft having a deck supported in the water by three pods.

BACKGROUND

Pontoon boats typically have a generally flat deck that is supported in the water by a pair of spaced apart pontoons. The stability of pontoon boats at rest and low speeds and their relatively large floor plans make them well suited for leisure and fishing.

However, the stability of pontoon boats tends to come at the cost of maneuverability and performance.

There is therefore a desire for a watercraft having the functionality and the stability of a pontoon boat at rest and low speeds, while improving the maneuverability and performance.

SUMMARY

It is an object of the present technology to ameliorate at least some of the inconveniences present in the prior art.

According to one aspect of the present technology, there is provided a watercraft having a deck, a central pod connected to a bottom of the deck, a left pod connected to the bottom of the deck, a right pod connected to the bottom of the deck, and a helm assembly disposed on the deck. The central pod is laterally centered relative to the deck. The central pod has a central hull defining a central tunnel having two side walls and a top wall, a motor connected to the central hull and disposed at least in part in the central hull, and a jet propulsion system operatively connected to the motor. At least a portion of the jet propulsion system is disposed in the central tunnel. The jet propulsion system has a steerable nozzle operatively connected to the jet propulsion system. The left pod is disposed at a left of the central pod and is laterally spaced from the central pod. The left pod has a left hull that is narrower than the central hull. The right pod is disposed at a right of the central pod and is laterally spaced from the central pod. The right pod has a right hull that is narrower than the central hull.

In some implementations of the present technology, the motor is an engine. The central pod also has a fuel tank connected to the central hull and disposed at least in part in the central hull. The fuel tank is fluidly connected to the engine.

In some implementations of the present technology, the central pod further also has an air box connected to at least one of the central hull, the fuel tank and the engine and disposed at least in part in the hull. The air box is fluidly connected to the engine.

In some implementations of the present technology, a fuel cap is disposed on a gunnel of the deck. A fuel filler neck extends from the fuel tank to the fuel cap.

In some implementations of the present technology, the central pod further also has a collar extending between a top edge of the central hull and the bottom of the deck. A top of the motor is disposed above the top edge of the central hull and below the bottom of the deck.

In some implementations of the present technology, a trap door is defined in the deck for providing access to the motor.

In some implementations of the present technology, at least a majority of a top surface of the deck is defined by a flat surface.

In some implementations of the present technology, a stern of the central hull is disposed forward of a stern of the left pod and of a stern of the right pod. A bow of the central hull is disposed rearward of a bow of the left pod and of a bow of the right pod.

In some implementations of the present technology, the deck extends forward of the bows of the central, left and right pods. The deck extends rearward of the stern of the central pod.

In some implementations of the present technology, the deck extends rearward of the stems of the left and right hulls.

In some implementations of the present technology, a transom deadrise angle of the central hull is smaller than a transom deadrise angle of the left hull. The transom deadrise angle of the central hull is smaller than a transom deadrise angle of the right hull. The transom deadrise angles of the left and right hulls are equal.

In some implementations of the present technology, the central hull has a central keel, the left hull has a left keel and the right hull has a right keel. The central keel is lower than the left and right keels.

In some implementations of the present technology, a first line extending left from the central keel at a transom deadrise angle of the central hull intersects a left vertical plane containing the left keel at a point vertically above the left keel and vertically below a top of the left pod. A second line extending right from the central keel at the transom deadrise angle of the central hull intersects a right vertical plane containing the right keel at a point vertically above the right keel and vertically below a top of the right pod.

In some implementations of the present technology, the left and right pods are one of identical and substantially identical to each other.

In some implementations of the present technology, each of the left and right pods is one of symmetrical and substantially symmetrical about a longitudinally extending vertical center plane of the pod.

In some implementations of the present technology, at least a front portion of the left pod is spaced from the bottom of the deck, and at least a front portion of the right pod is spaced from the bottom of the deck.

In some implementations of the present technology, a width of the central pod is greater than a combined width of the left and right pods.

In some implementations of the present technology, a right side of the left pod, a left side of the central pod and a portion of the bottom of the deck disposed laterally between the left and central pods define a left channel, the left channel extending along an entire length of the central pod. A left side of the right pod, a right side of the central pod and another portion of the bottom of the deck disposed laterally between the right and central pods define a right channel, the right channel extending along an entire length of the central pod.

In some implementations of the present technology, the left pod defines at least in part a left passage fluidly communicating the left channel with a left side of the left pod. The right pod defines at least in part a right passage fluidly communicating the right channel with a right side of the right pod.

In some implementations of the present technology, the left pod has a front left sub-pod having a front left hull, and a rear left sub-pod having a rear left hull. The rear left sub-pod is disposed rearward of the front left sub-pod. The front left hull and the rear left hull define the left hull. The right pod has a front right sub-pod having a front right hull, and a rear right sub-pod having a rear right hull. The rear right sub-pod is disposed rearward of the front right sub-pod. The front right hull and the rear right hull define the right hull.

In some implementations of the present technology, a bow of the front left sub-pod extends upward as the bow of the front left sub-pod extends forward. A transom of the front left sub-pod defines a notch. A bow of the rear left sub-pod is received at least in part in the notch of the front left sub-pod. A bow of the front right sub-pod extends upward as the bow of the front right sub-pod extends forward. A transom of the front right sub-pod defines a notch. A bow of the rear right sub-pod is received at least in part in the notch of the front right sub-pod.

In some implementations of the present technology, the transom of the front left hull extends downward as the transom of the front left hull extends forward. The transom of the front right hull extends downward as the transom of the front right hull extends forward.

In some implementations of the present technology, the rear left hull defines a forwardly extending notch in a rear thereof. The rear right hull defines a forwardly extending notch in a rear thereof.

In some implementations of the present technology, the front left, rear left, front right and rear left sub-pods are one of identical and substantially identical to each other.

In some implementations of the present technology, the front left hull is discretely molded, the rear left hull is discretely molded, the front right hull is discretely molded, the rear right hull is discretely molded, and the central hull is discretely molded.

In some implementations of the present technology, the central hull is molded separately from the left and right hulls.

In some implementations of the present technology, a volume of the central hull is greater than a combined volume of the left and right pods.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
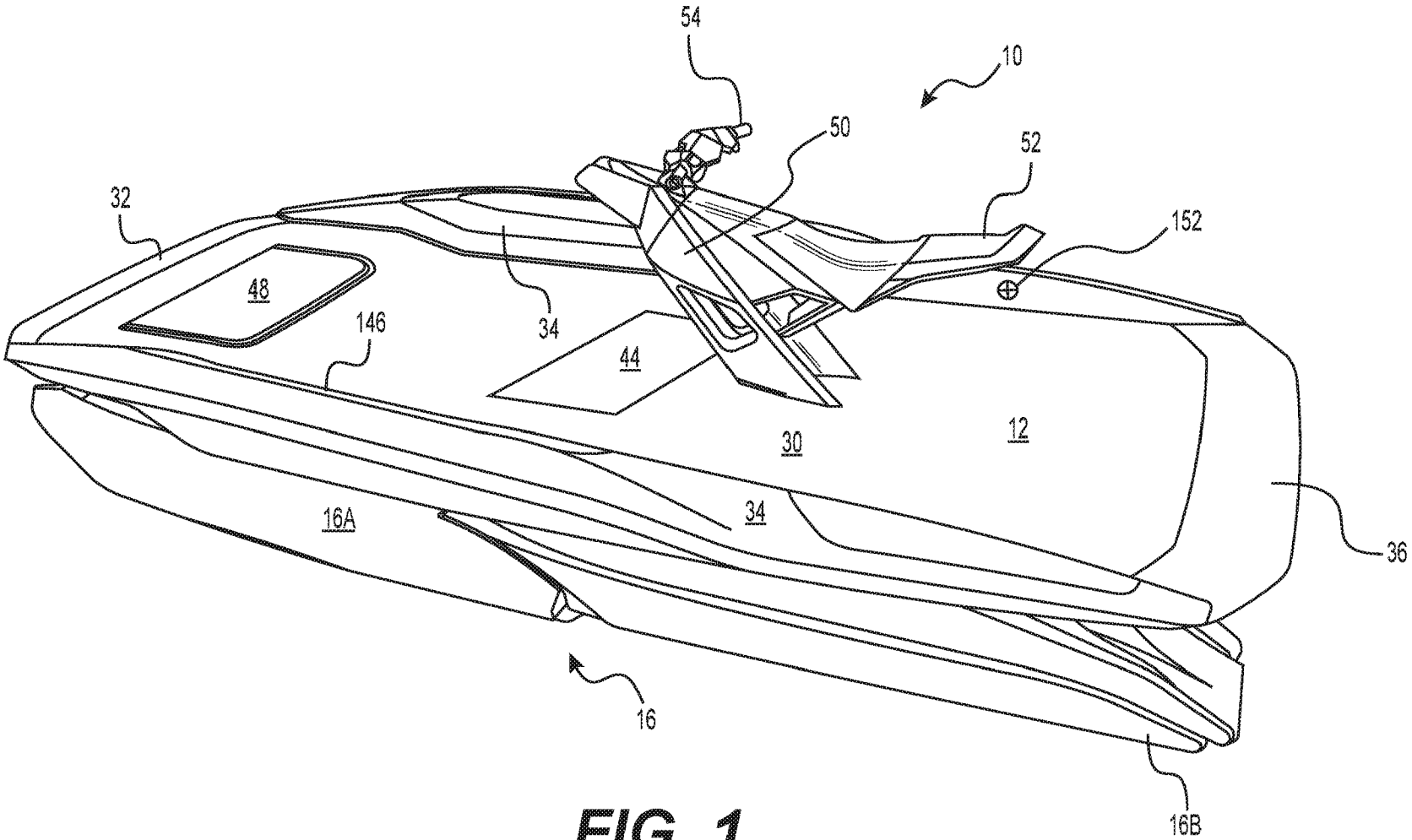
FIG. 1 is a perspective view taken from a rear, left side of a watercraft.
Figure 2:
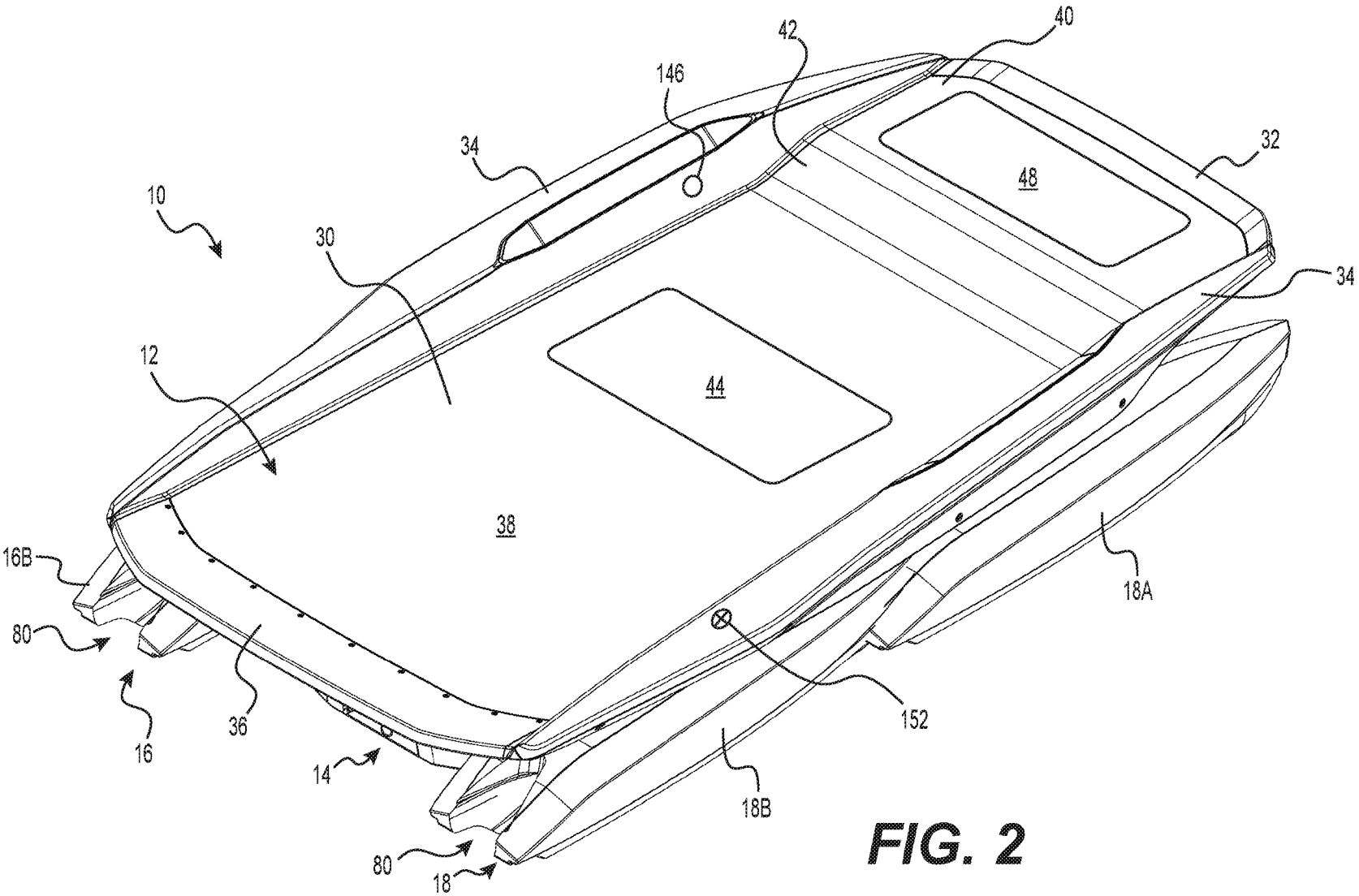
FIG. 2 is a perspective view taken from a rear, right side of the watercraft of FIG. 1, with a seat and helm assembly removed.

As can be seen in FIGS. 1 to 7, a watercraft 10 has a deck 12, a central pod 14, a left pod 16 and a right pod 18. The pods 14, 16, 18 are connected to a bottom of the deck 12 as will be described in greater detail below. The central pod 14 is laterally centered relative to the deck 12. The left and right pods 16, 18 are disposed to the left and right of the central pod 14 respectively. The pods 14, 16, 18 buoyantly support the deck 12 above water.

The left pod 16 is made of a front sub-pod 16A and a rear sub-pod 16B disposed rearward of the front sub-pod 16B and being laterally aligned therewith. Similarly, the right pod 18 is made of a front sub-pod 18A and a rear sub-pod 18B disposed rearward of the front sub-pod 18B and being laterally aligned therewith. It is contemplated that each of the left and right pods 16, 18 could be formed by a single pod or by more than two sub-pods.

Figure 4:
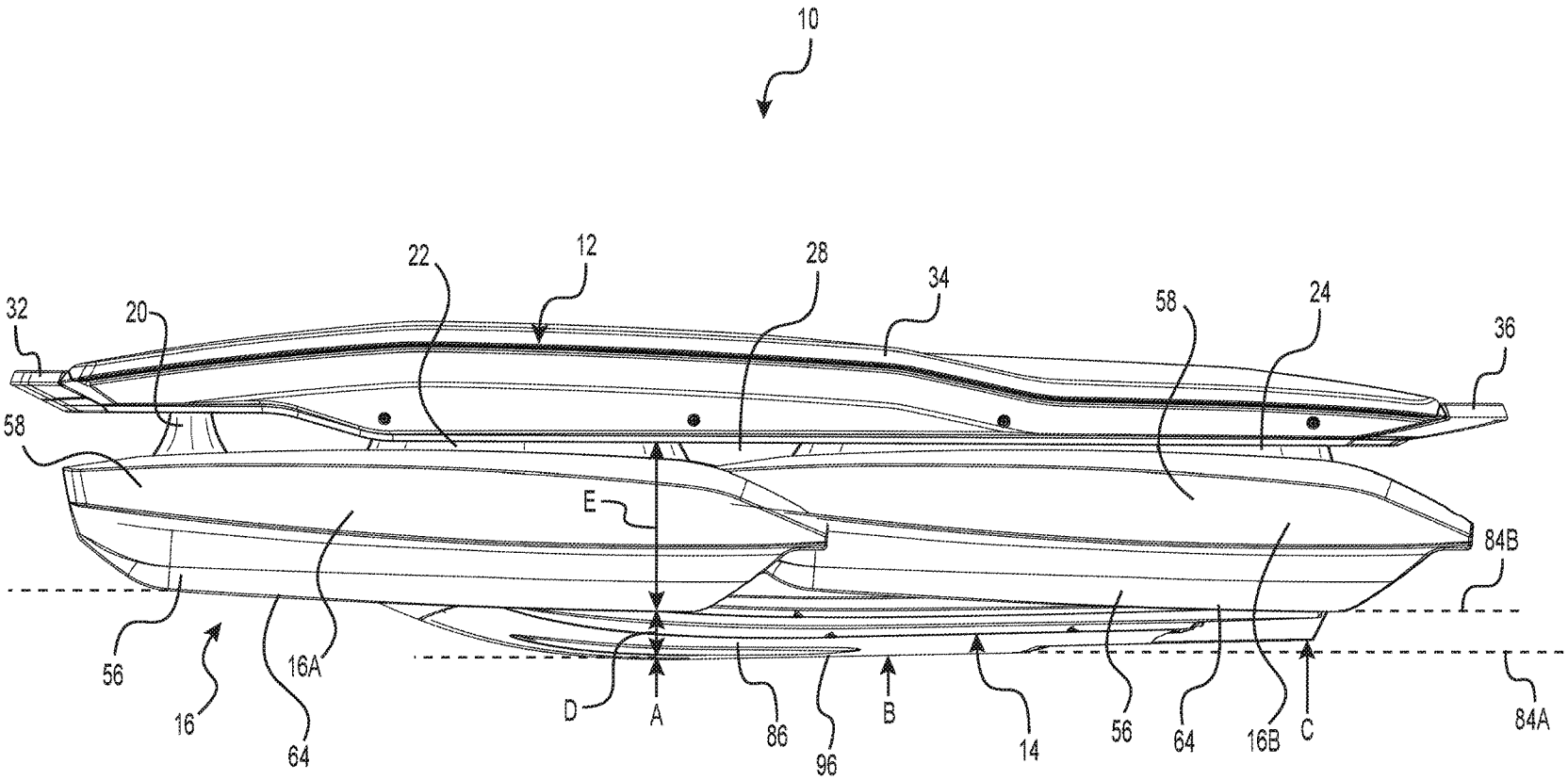
FIG. 4 is a left side elevation view thereof.

As best seen in FIG. 4, the front left sub-pod 16A is connected to the bottom of the deck 12 by a leg 20 and a leg 22. It is contemplated that the front left sub-pod 16A could be connected to the bottom of the deck 12 by a single leg or by more than two legs. It is contemplated that the front left sub-pod 16A could be connected to the bottom of the deck 12 in other ways, such as by brackets or posts, or by being connected directly to the bottom of the deck 12. It is also contemplated that the legs 20 and 22 could be integrally formed with the front left sub-pod 16A or the deck 12. As can seen, the bottom of the deck 12 defines a step at its front such that the front of the front left sub-pod 16A is more spaced from the bottom of the deck 12 than the rear portion of the front left sub-pod 16A. The front right sub-pod 18A is connected to the bottom of the deck 12 in the same way as the front left sub-pod 16A.

As can also be seen in FIG. 4, the rear left sub-pod 16B is connected to the bottom of the deck 12 by a leg 24. It is contemplated that the rear left sub-pod 16B could be connected to the bottom of the deck 12 by more than one leg. It is contemplated that the rear left sub-pod 16B could be connected to the bottom of the deck 12 in other ways, such as by brackets or posts, or by being connected directly to the bottom of the deck 12. It is also contemplated that the leg 24 could be integrally formed with the rear left sub-pod 16B or the deck 12. The rear right sub-pod 18B is connected to the bottom of the deck 12 in the same way as the rear left sub-pod 16B.

Figure 5:
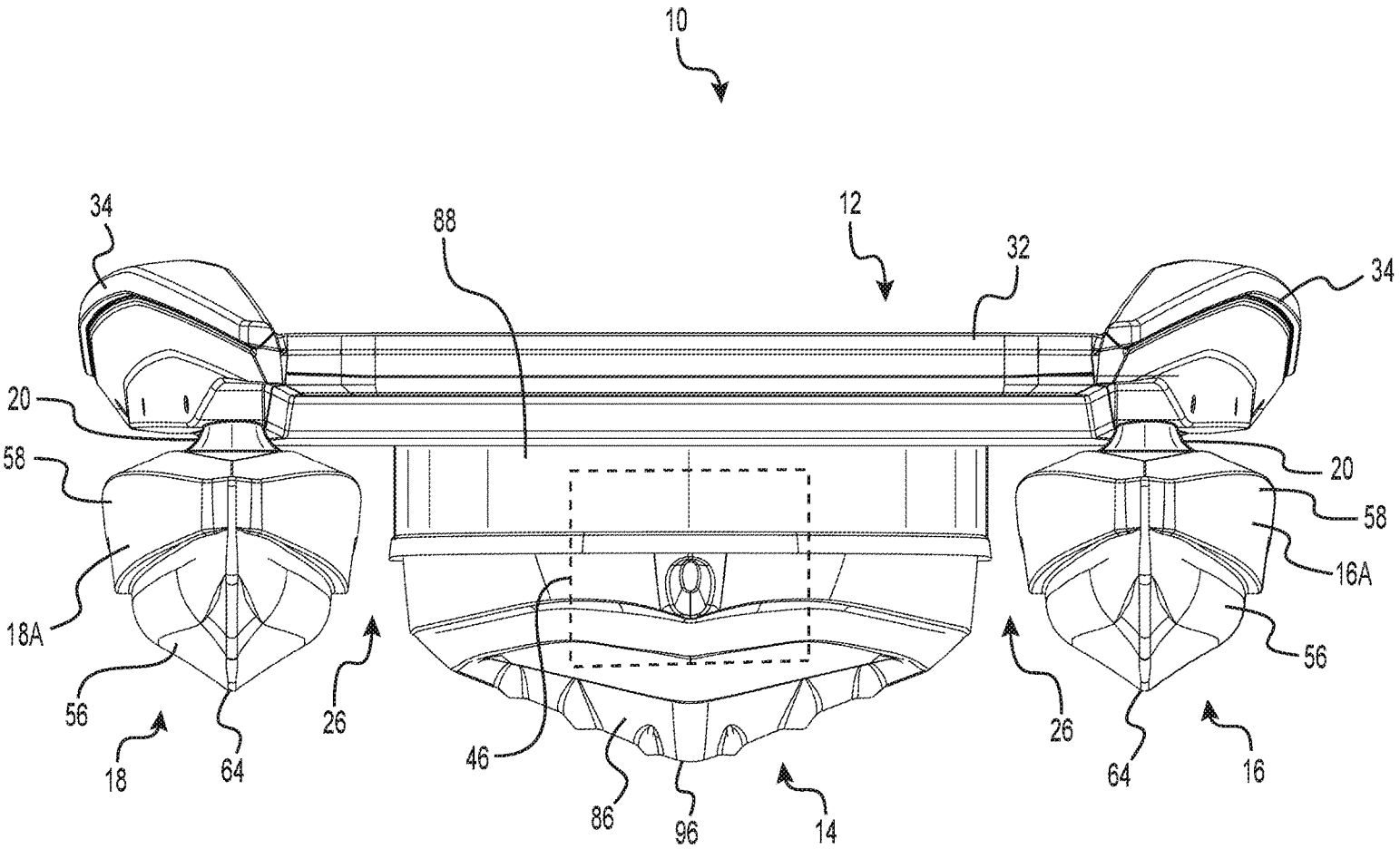
FIG. 5 is a front elevation view thereof.
Figure 6:
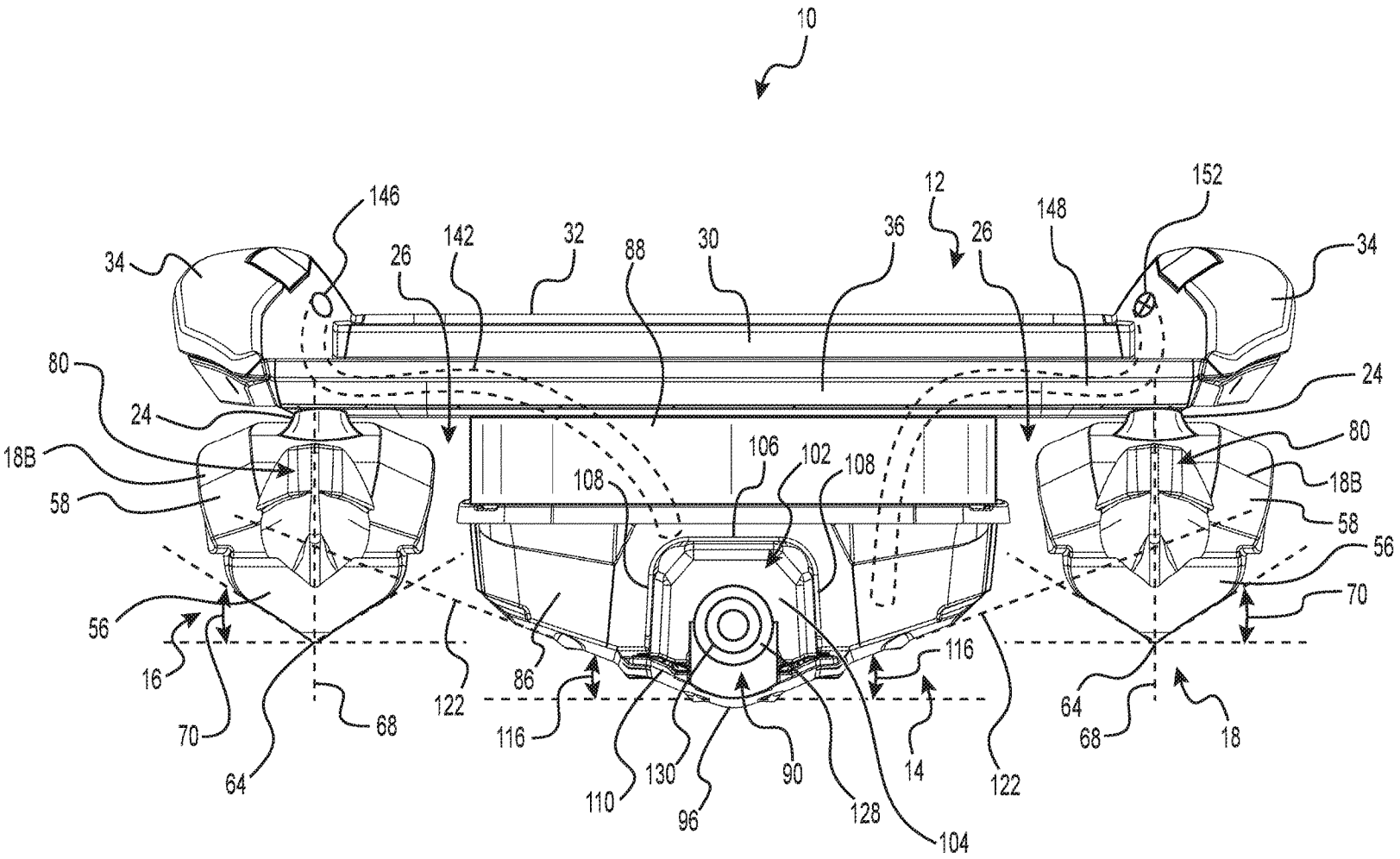
FIG. 6 is a rear elevation view thereof.

As can be seen in FIGS. 5 and 6, the watercraft 10 has left and right channels 26 defined between the pods 14, 16, and 18 permitting the passage of water below the deck 12. More specifically, the left channel 26 is defined between the right side of the left pod 16, the left side of the central pod 14 and the portion of the deck 12 disposed laterally between the central and left pods 14, 16. The left channel 26 extends along an entire length of the central pod 14. Similarly, the right channel 26 is defined between the left side of the right pod 18, the right side of the central pod 14 and the portion of the deck 12 disposed laterally between the central and right pods 14, 18. The right channel 26 extends along an entire length of the central pod 14. In order to permit the evacuation of some of the water flowing in the channels 26, side passages 28 are defined in part by the pods 16, 18. More specifically, as can be seen in FIG. 4 the left side passage 28 is defined by the top portion of the left pod 16 where the front and rear sub-pods 16A, 16B meet, the left legs 22 and 24 and the bottom portion of the deck 12 located between the legs 22, 24. Similarly, the right passage 28 (not shown, but being a mirror image of the left side passage 28) is defined by the top portion of the right pod 18 where the front and rear sub-pods 18A, 18B meet, the right legs 22 and 24 and the bottom portion of the deck 12 located between the legs 22, 24. During operation of the watercraft 10, some of the water flowing in the channels 26 will flow through the passages 28 to the outside of the watercraft 10 on the left of the left pod 16 and on the right of the right pod 18.

The pods 16A, 16B, 18A, 18B will be described in greater detail further below with respect to FIGS. 13 to 16.

Turning now to FIGS. 1, 3 and 8 to 12, the deck 12 will be described in greater detail. In the present implementation, the deck 12 has a generally rectangular (as viewed from above, FIG. 3) main portion 30 from which extend a front lip 32, left and right gunnels 34 and a rear ledge 36. It is contemplated that two or more of these components of the deck 12 could be integrally formed or fastened or connected to each other by other means such as by bonding or welding for example. The deck 12 is sized such that it extends forward and rearward of the pods 14, 16, 18 (see FIG. 7). Also, the left and right pods 16, 18 are sized and located relative to the deck 12 such that they are located in part laterally inward of the left and right sides of the deck 12 (see FIGS. 5 to 7).

Figure 18:
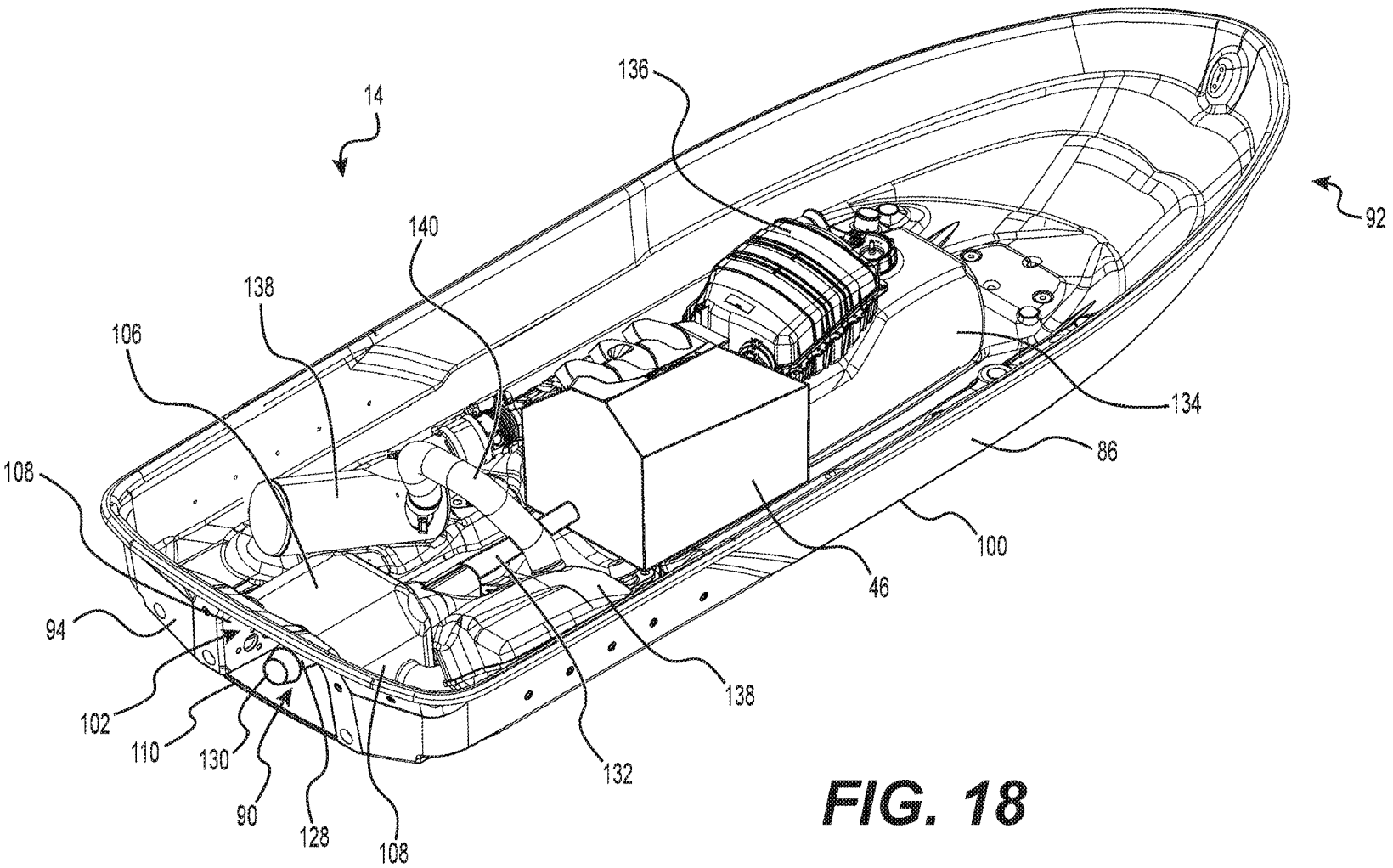
FIG. 18 is a perspective view of the central pod of FIG. 17 taken from a rear, right side thereof, without the collar.

The central and rear portions of the top surface of the main portion 30 of the deck 12 are defined by a flat surface 38. The flat surface 38 defines a majority of the top surface of the deck 12. A front portion of the top surface of the main portion 30 of the deck 12 is defined by a flat surface 40 that is raised relative to the flat surface 38. An angled surface 42 provides the transition between the flat surfaces 38, 40. A trap door 44 is defined in the surface 38 of the main portion 30 of the deck 12. The trap door 44 covers an aperture (not shown) that extends through the deck 12 and that provides access to components of the central pod 14 such as the engine 46 (FIG. 18). A trap door 48 is defined in the surface 40 of the main portion 30 of the deck 12. The trap door 48 covers a storage compartment (not shown) defined in the front portion of the main portion 30 of the deck 12. It is contemplated that the trap door 48 and its corresponding storage compartment could be omitted. It is contemplated that he trap doors 44 and 48 can be hinged to the main portion 30 of the deck 12 or be removable from the main portion 30 of the deck 12.

As can be seen in FIG. 4, and as described above, the front portion of the bottom surface of the main portion 30 of the deck 12 is raised relative to the remainder of the bottom surface of the main portion 30 of the deck 12 which is generally flat. The raised front portion of the bottom surface of the deck 30 helps reduce water splashing onto the top of the deck 12 and its occupants when the watercraft 10 is moving forward.

In the present implementation, the main portion 30 (other than the trap doors 44, 48) is of unitary construction, but it is contemplated that it could be made of two or more sections joined together.

The front lip 32 is fastened to the front of the main portion 30 of the deck 12. The front lip 32 extends the entire width of the main portion 30 of the deck 12. The front lip 32 provides an upturned front surface that helps reduce the entry of water onto the deck 12. As can be seen in the figures, the left and right ends of the front lip 32 are shaped so as to provide a smooth transition from the front ends of the gunnels 34.

Figure 3:
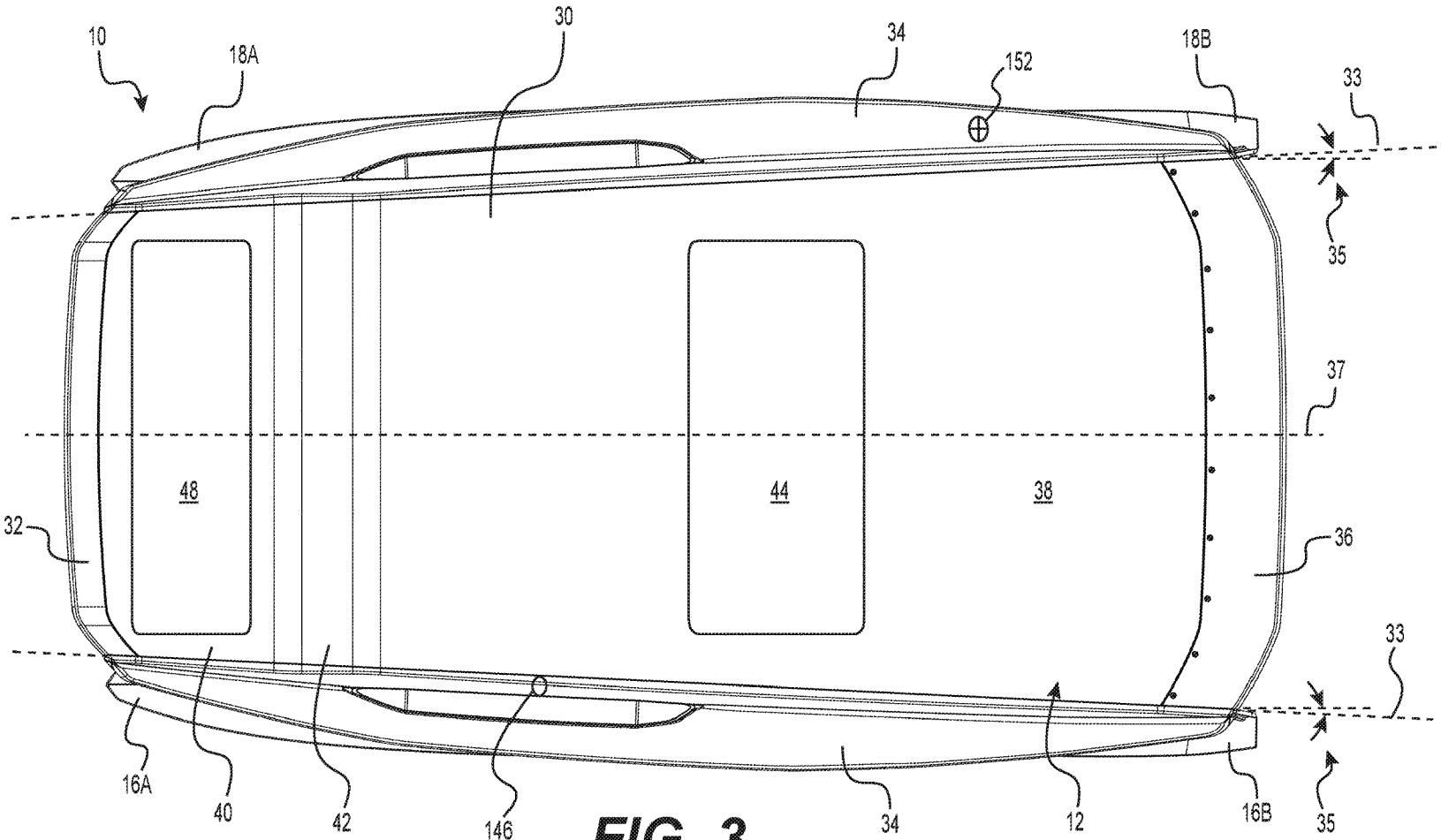
FIG. 3 is a top plan view thereof.
Figure 8:
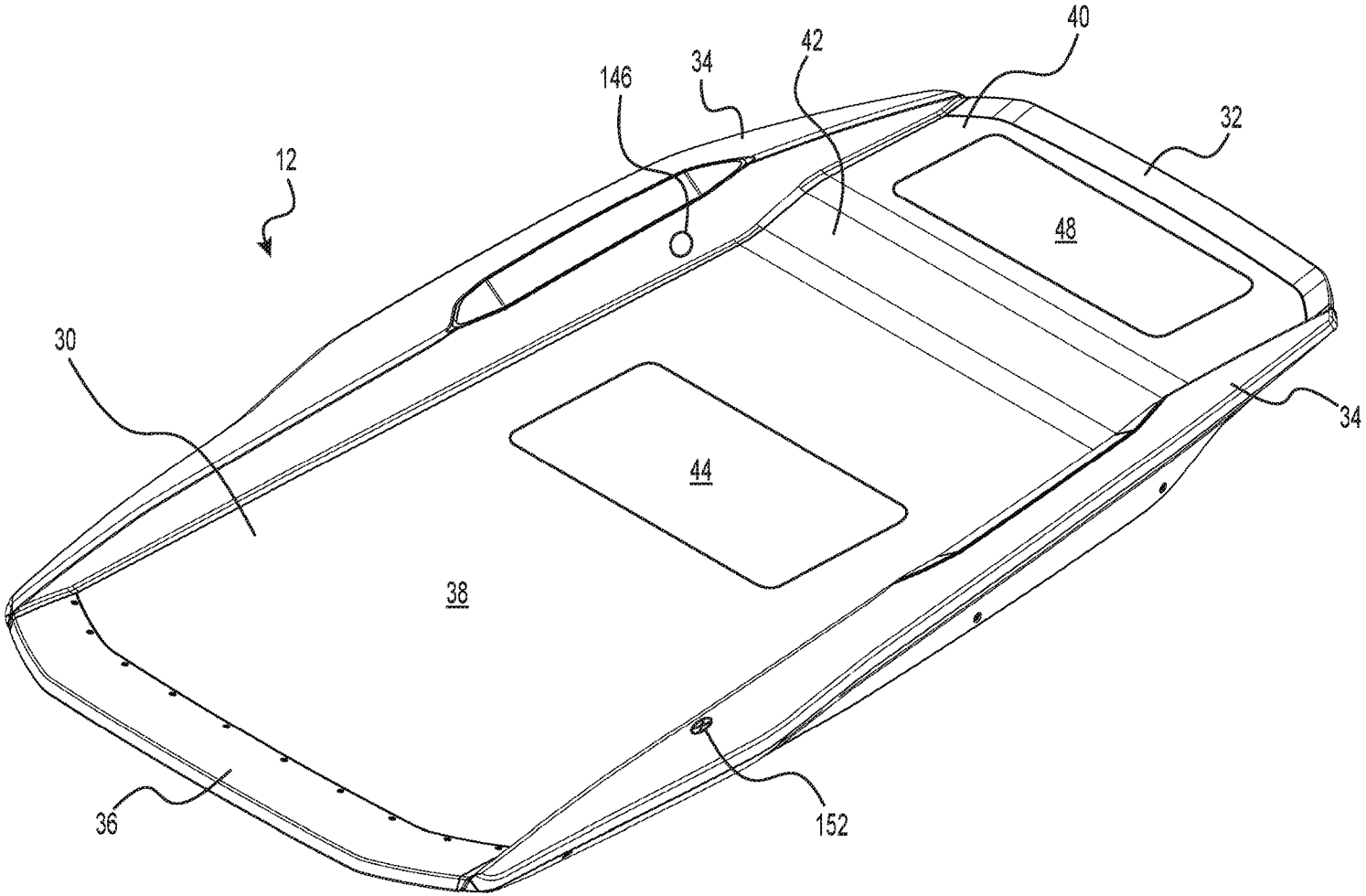
FIG. 8 is a perspective view taken from a rear, right side of a deck of the watercraft of FIG. 1.
Figure 9:
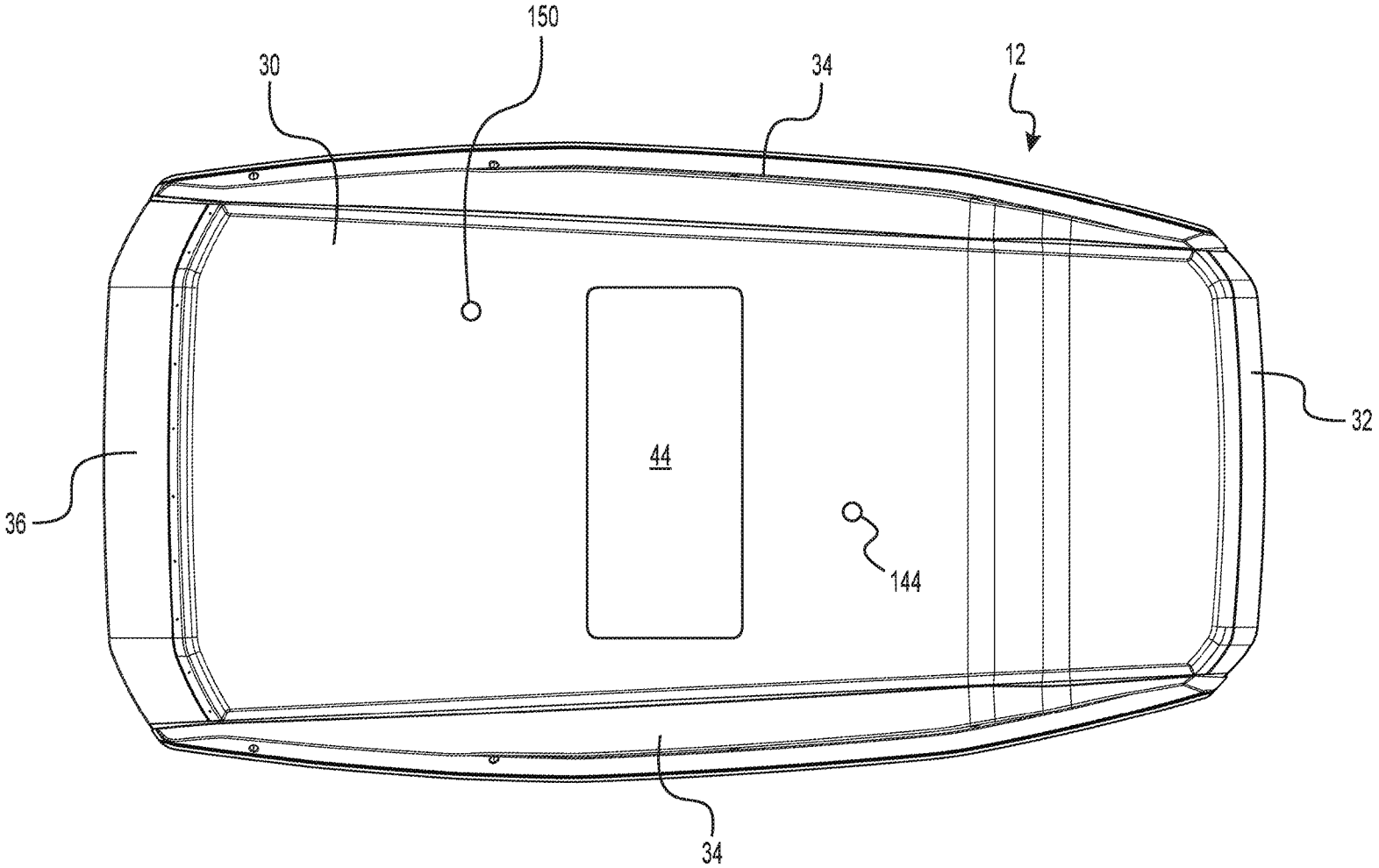
FIG. 9 is a bottom plan view thereof.
Figure 10:
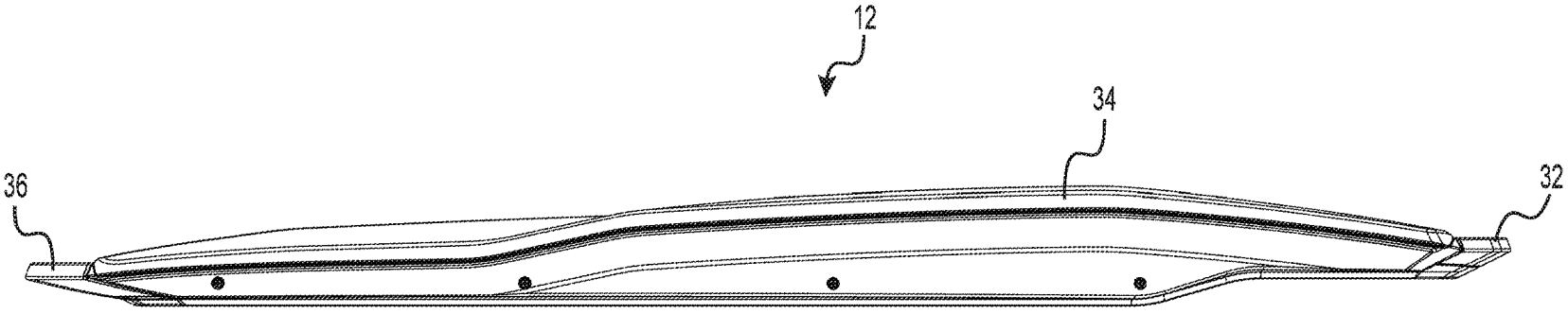
FIG. 10 is a right side elevation view thereof.
Figure 11:
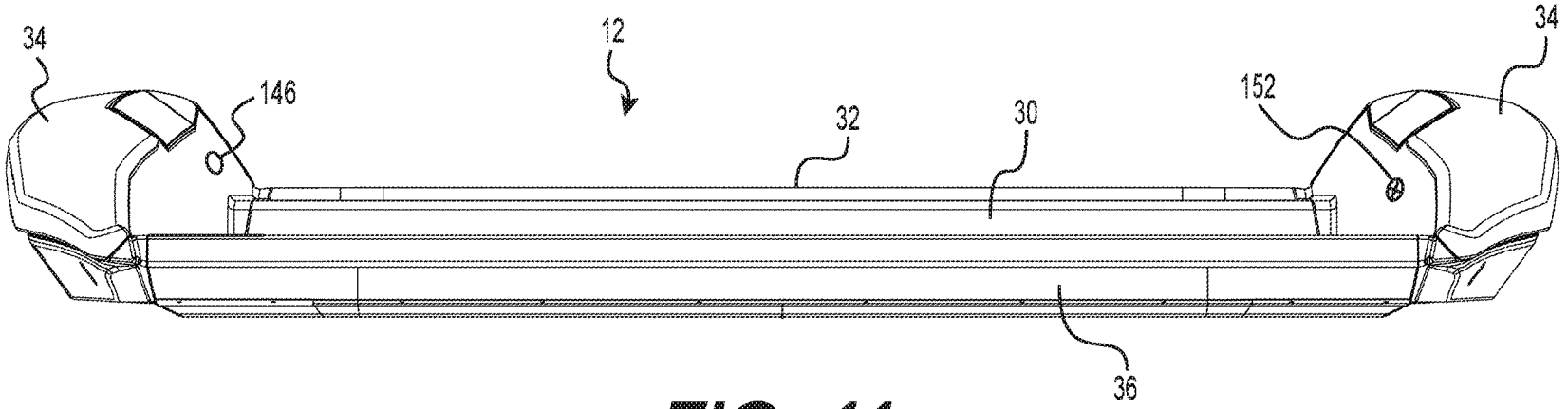
FIG. 11 is a rear elevation view thereof.
Figure 12:
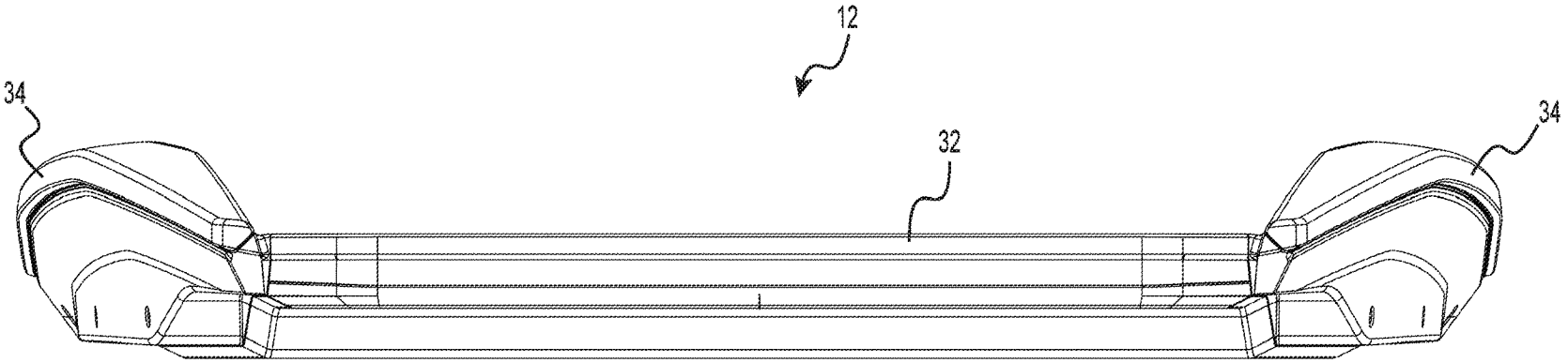
FIG. 12 is a front elevation view thereof.

The left and right gunnels 34 are fastened to the left and right sides respectively of the main portion 30 of the deck 12. The gunnels 34 extend from the rear edge of the rear ledge 36 to the left and right ends of the front lip 32. The gunnels 34 provide raised side portions that help reduce the entry of water from the sides of the deck 12. As can be seen in FIGS. 8 and 10, a thickness of the gunnels 34 increases from the rear ends of the gunnels 34 up to portions of the gunnels 34 longitudinally aligned with the angled surface 42, and then decreases up to the front ends of the gunnels 34. As best seen in FIG. 3, the distance between the gunnels 34 increases from the front of the deck 12 to the rear of the deck 12 as can be seen from the lines 33 that extend along the intersections of the gunnels 34 with the main portion 30 of the deck 12. The lines 33 extend at an angle 35 to a longitudinal centerline 37 of the watercraft 10. In the present implementation, the angle 35 is 2.25 degrees, but other angles are contemplated.

The rear ledge 36 is fastened to the rear of the main portion 30 of the deck 12. As can be seen in FIG. 10, the bottom of the rear ledge 36 extends upward as it extends rearward. As can be seen in FIG. 8, the top of the rear ledge 36 is flat and provides an extension of the flat surface 38 of the main portion 30 of the deck 12.

As can be seen in FIG. 1, a cantilevered structure 50 is mounted to the top of the main portion 30 of the deck 12 on the surface 40. The cantilevered structure 50 is disposed rearward of the trap door 44 and is laterally centered on the deck 12. A straddle seat 52 is connected to the cantilevered structure 50 and extends rearward thereof. A helm assembly including a handlebar 54 is provided on top of the cantilevered structure 50 forward of the straddle seat 52 to permit steering of the watercraft 10 as will be described in greater detail below. A throttle lever (not shown) is provided on the handlebar 54 to control a speed of the watercraft 10. It is contemplated that the straddle seat 52 could be replaced by a bucket seat, a bench or another type of seat that may or may not require the cantilevered structure 50. It is also contemplated that additional seats could be provided on the main portion 30 of the deck 12. It is also contemplated that the handlebar 54 could be replaced by a steering wheel, a joystick or other steering input device. It is also contemplated that other structures such as guard rails, storage and a wakeboard tower for example could be provided on the main portion 30 of the deck 12.

Turning now to FIGS. 13 to 16, the front left sub-pod 16A will be described in greater detail. In the present implementation, the rear left sub-pod 16B, the front right sub-pod 18A and the rear right sub-pod 18B are identical to the front left sub-pod 16A. It is contemplated that the sub-pods 16A, 16B, 18A and 18B could differ cosmetically and/or aesthetically and/or by minor structural difference, such as the addition of apertures to mount a bracket on one or more of the sub-pods 16A, 16B, 18A and 18B, without affecting their intended functionality, in which case they are referred to herein as being substantially identical to each other. Sub-pods 16A, 16B, 18A and 18B made from identical molds but modified following the molding process are considered as being substantially identical to each other. It is also contemplated that the sub-pods 16A, 16B, 18A, 18B could not be identical to each other. For example, it is contemplated that the two front sub-pods 16A and 18A could be identical to each other and the the two rear sub-pods 16B and 18B could be identical to each other but different from the front sub-pods 16A and 18A. It is also contemplated that the left sub-pods 16A and 16B could be mirror images of the right sub-pods 18A and 18B. Although only the front left sub-pod 16A is described in detail below, in order to differentiate between corresponding elements of the various sub-pods 16A, 16B, 18A, 18B in later descriptions, components of the front left sub-pod 16A will be referred to as "front left" components, components of the rear left sub-pod 16B will be referred to as "rear left" components, components of the front right sub-pod 18A will be referred to as "front right" components, and components of the rear right sub-pod 18B will be referred to as "rear left" components.

The sub-pod 16A has a hull 56 and a top 58 disposed on top of the hull 56. The hull 56 and the top 58 are connected to each other such that a seal is formed between the two to prevent the entry of water inside the sub-pod 16A. In some implementations, the space defined between the hull 56 and the top 58 is filled partially or completely with a low density material such as closed-cell foam. As a result, the sub-pod 16A will not fill up with water should the hull 56 or the top 58 be punctured or should the sealed connection between the hull 56 and the top 58 fail. The hull 56 and the top 58 can be made by a plastic injection molding process or by a composite material laying or spraying process. In another implementation, the hull 56 and the top 58 are integrally formed. This can be achieved by a blow-molding or a rotomolding process for example. In many of the contemplated implementations, the hull 56 is discretely molded such that it is made of a single part, thereby reducing the likelihood of water intrusion. In the present implementation, sub-pod 16A is symmetrical about a longitudinally extending vertical center plane of the pod 68 (FIG. 6, a plane extending through the keel 64 described below). It is contemplated that the left and right sides of the sub-pod 16A could differ cosmetically and/or aesthetically and/or by minor structural difference, such as the addition of apertures to mount a bracket on one side but not on the other, in which case it is referred to herein as being substantially symmetrical. It is also contemplated that the sub-pod 16A could not be symmetrical.

Figure 14:
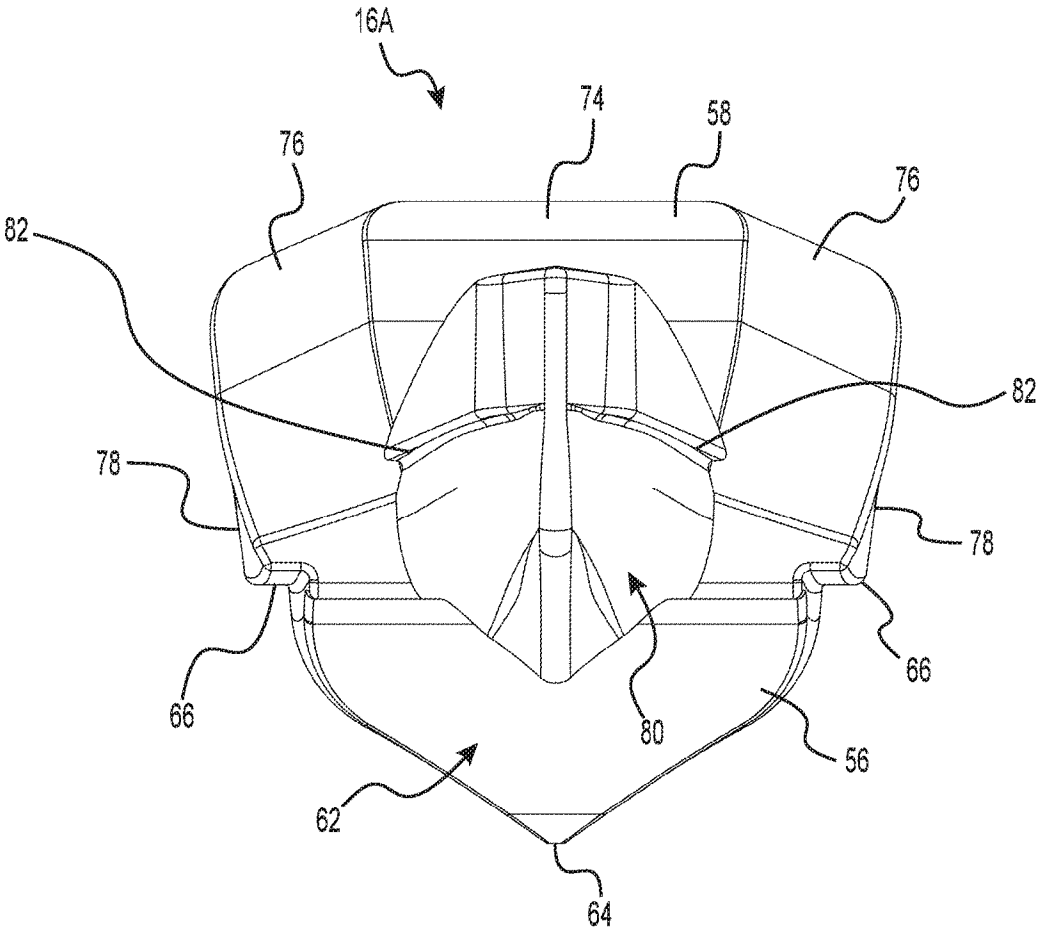
FIG. 14 is a rear elevation view thereof.

As best seen in FIG. 14, the hull 56 is what is commonly referred to as an S-bottom hull. The hull 56 has a bow 60, a transom 62, and a keel 64. The hull 56 also defines a pair of reverse chines 66 (FIG. 14). The reverse chines 66 help reduce water spray during operation of the watercraft 10, facilitate lift during acceleration and improve stability at rest. It is contemplated that both reverse chines 66 or that the laterally inward reverse chine 66 (i.e. the right reverse chine on the front left sub-pod 16A) could be omitted. The hull 56 is symmetrical about a vertical plane 68 passing through the keel 64. It is contemplated that the hull 56 could be asymmetric about the vertical plane passing through the keel 64.

Figure 13:
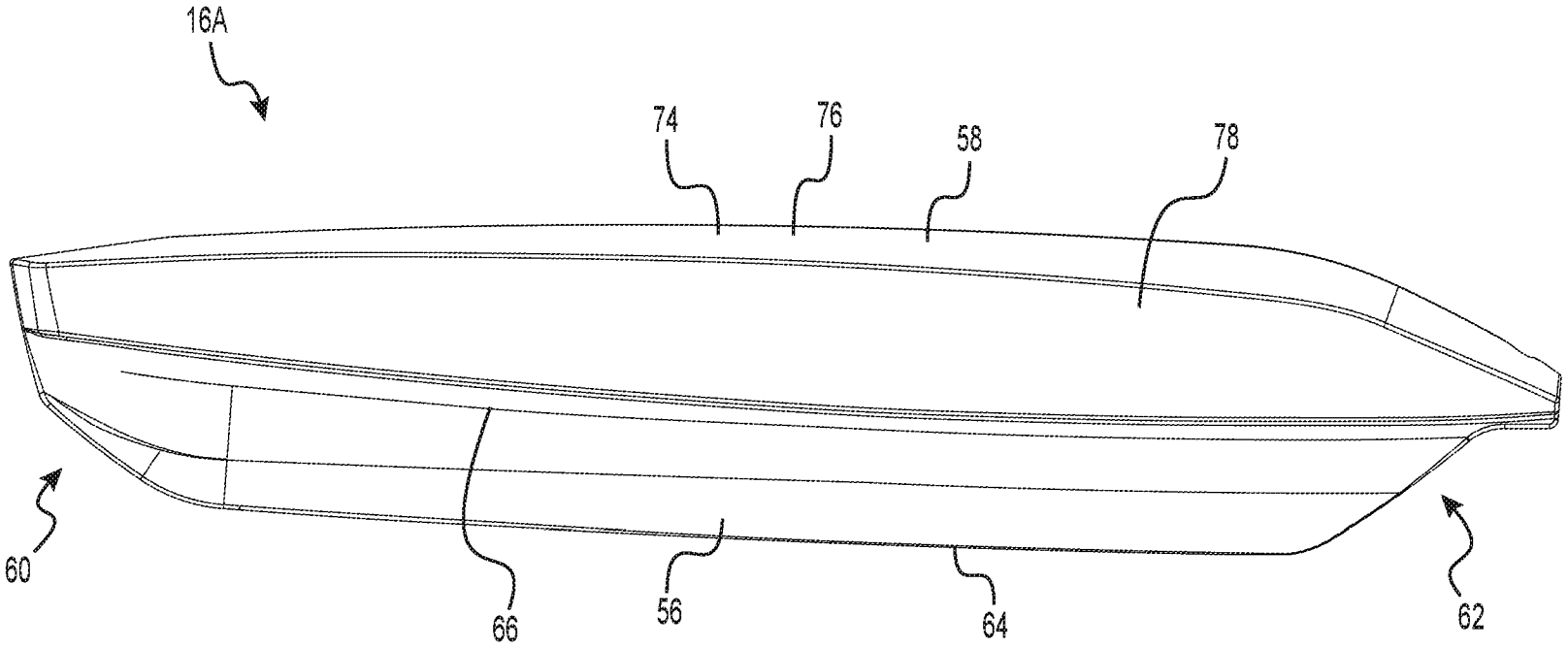
FIG. 13 is a left side elevation view of a side sub-pod of the watercraft of FIG. 1.
Figure 15:
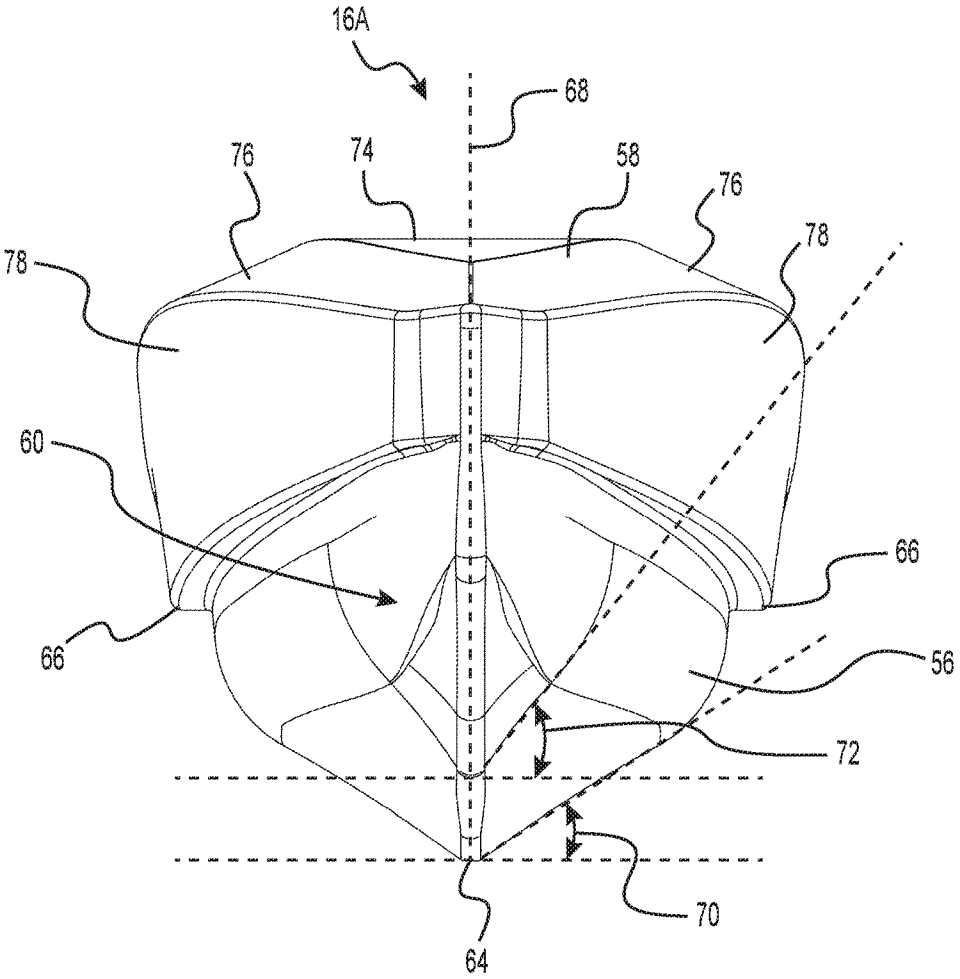
FIG. 15 is a front elevation view thereof.
Figure 16:
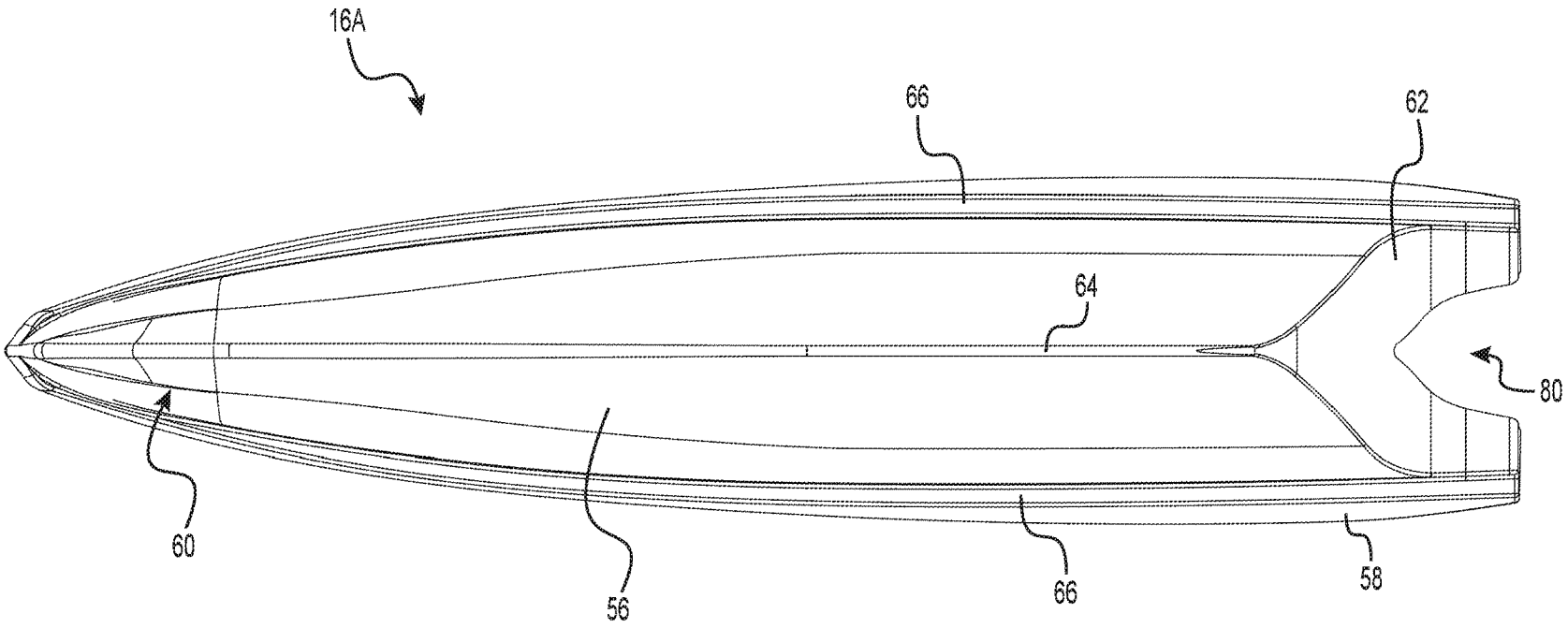
FIG. 16 is a bottom plan view thereof.

As can be seen in FIG. 16, the hull 56 tapers as it extends from the transom 62 to the bow 60. As can also be seen in FIG. 16, the hull 56 is long and narrow. In one implementation, the length-to-beam ratio of the hull 56 is about 4.5. The hull 56 is about half the length of the deck 12. As can be seen in FIG. 13, the bow 60 is arcuate and extends upward as it extends forward. The transom 62 is also arcuate, but less than the bow 60, and extends upward as it extends rearward. The hull 56 also has a varying deadrise angle. As can be seen in FIG. 15, the transom deadrise angle 70 is smaller than the bow deadrise angle 72.

As can be seen in FIG. 14, as seen from behind, the top 58 has a generally flat central section 74, two downwardly angled side sections 76 and side walls 78. As can be seen in FIG. 13, the central section 74 is generally flat in the longitudinal direction for a majority of the length of the top 58 but curves downward at the front and rear thereof.

As best seen in FIG. 16, the transom of the sub-pod 16A defines a notch 80. The notch 80 extends vertically through both the hull 56 and the top 58 of the sub-pod 16A and extends forwardly into the sub-pod 16A. As seen in FIG. 16, the notch 80 is generally U-shaped. As can be seen in FIG. 14, the notch 80 also defines two small ledges 82. The widest portion of the notch 80 is about half the width of the transom of the sub-pod 80. A length of the notch 80 (i.e. its longitudinal dimension along the keel 64) is about the same as its width at its widest portion.

For the rear sub-pods 16B, 18B, the notch 80 reduces the contact area of the hulls 56 with the water, thereby reducing the resistance to the watercraft 10 pitching up during acceleration. As a result, the notches 80 in the rear sub-pods 16B, 18B make it easier for the watercraft 10 to get on plane. It is contemplated that the notches 80 could be omitted from the rear sub-pods 16B, 18B.

Figure 7:
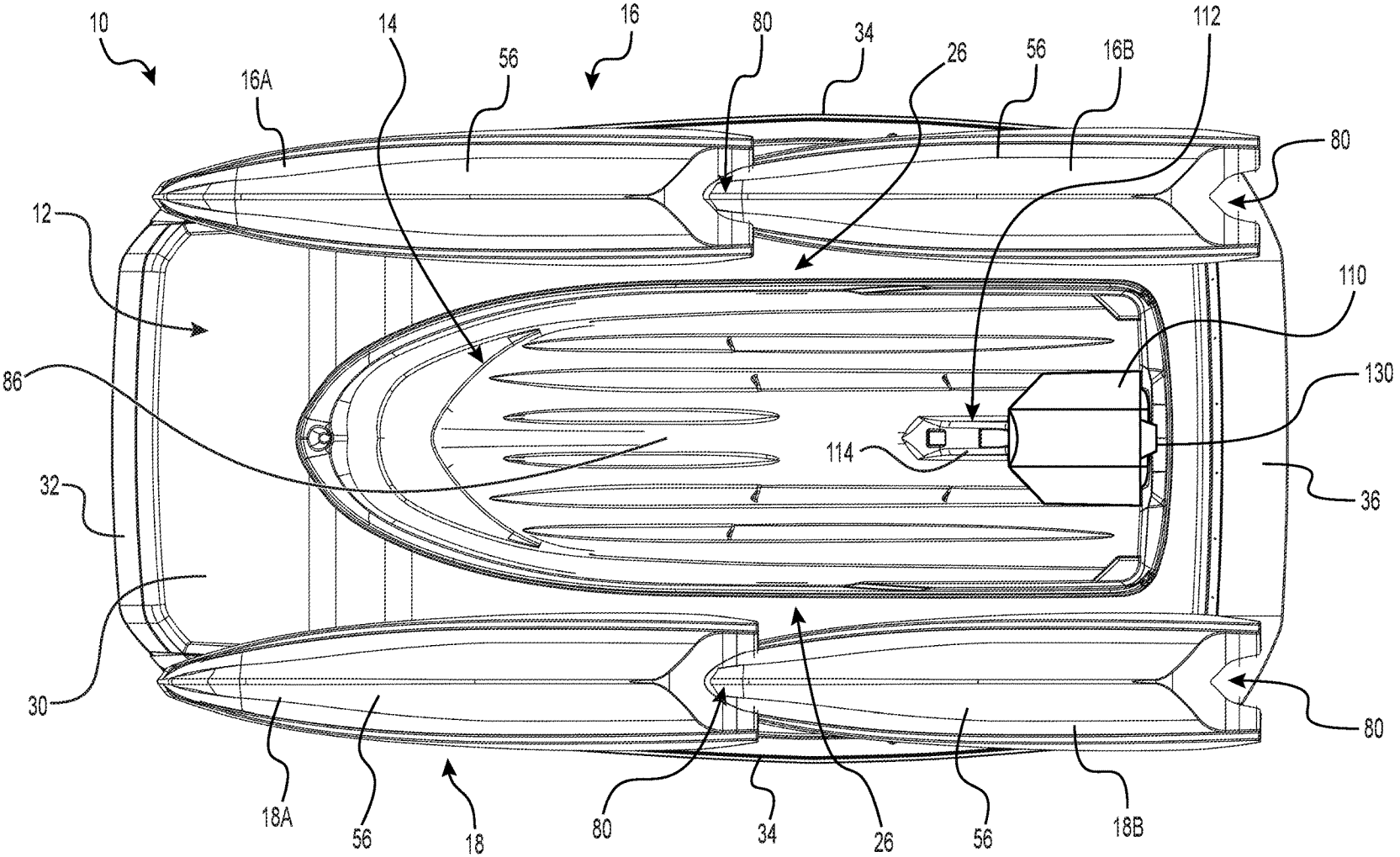
FIG. 7 is a bottom plan view thereof.

The notches 80 in the front sub-pods 16A, 18A serve a different purpose. As best seen in FIGS. 4 and 7, when the sub-pods 16A, 16B, 18A, 18B are connected to the deck 12 as described above, the front portions of the bows 60 of the rear sub-pods 16B, 18B are received in the notches 80 of their corresponding front sub-pods 16A, 18A. The portions of the reverse chines 66 located at the front of the rear sub-pods 16B, 18B sit on the ledges 82 defined by the notches 80 of the front sub-pods 16A, 18A.

As can also be seen in FIG. 7, when the sub-pods 16A, 16B, 18A, 18B are connected to the deck 12, the sub-pod 16A is laterally aligned with the sub-pod 16B and the sub-pod 18A is laterally aligned with the sub-pod 18B. As such, a hull of the left pod 16 is made of the front left hull 56 of the front left sub-pod 16A and the rear left hull 56 of the rear left sub-pod 16B. Similarly, a hull of the right pod 18 is made of the front right hull 56 of the front right sub-pod 18A and the rear right hull 56 of the rear right sub-pod 18B. As also can be seen in FIG. 7, the deck 12 extends rearward of the sterns of the rear left and right sub-pods 16B, 18B and the deck 12 extends forward of the bows 60 of the front left and right sub-pods 16A, 18A.

When the sub-pods 16A, 16B, 18A, 18B are connected to the deck 12, the hulls 56 of the sub-pods 16A, 16B, 18A, 18B are tilted slightly such that the portions of the hulls 56 directly behind the bows 60 are higher than the transoms 62. As can be seen in FIG. 4 for the sub-pods 16A, 16B, the lines 84A, 84B that extend along the keels 64 of the front left hull 56 and the rear left hull 56 are angled such that they extend downward as they extend rearward. In the present implementation, the lines 84A, 84B are parallel to each other, but it is contemplated that they could be skewed relative to each other. It is also contemplated that the sub-pods 16A, 16B, 18A, 18B could not be tilted such that the lines 84A, 84B are horizontal and could be coaxial or parallel should the front sub-pods 16A, 18A be higher or lower than the rear sub-pods 16A, 18B.

Turning now to FIGS. 5 to 7, 17 and 18, the central pod 14 will be described in more detail. The central pod 14 has a central hull 86, a collar 88, the engine 46 and its associated components (described in more detail below) and a jet propulsion system 90.

The central hull 86 has a bow 92, a transom 94 and a central keel 96. The bow 92 is arcuate and extends upward as it extends forward. The transom 94 is generally vertical. The central hull 86 is also provided with a combination of strakes 98 and chines 100. A strake 98 is a protruding portion of the central hull 86. A chine 100 is the vertex formed where two surfaces of the central hull 86 meet. The central hull 86 also defines a central tunnel 102. As best seen in FIG. 6, the central tunnel 102 is defined by a front wall 104, a top wall 106 and two side walls 108 defined by the central hull 86. The bottom of the central tunnel 102 is closed by a ride plate 110 that is fastened to the central hull 86. The central hull 86 also defines a water inlet 112 (FIG. 7) in front of the ride plate 110. The water inlet 112 is the inlet through which water is supplied to the jet propulsion system 90. An inlet grate 114 (FIG. 7) is fastened to the central hull 86 and extends over the water inlet 112 to prevent the entry of large debris into the jet propulsion system 90. The central hull 86 can be made by a plastic injection molding process or by a composite material laying or spraying process. In many of the contemplated implementations, the central hull 86 is discretely molded such that it is made of a single part, thereby reducing the likelihood of water intrusion.

The width of the central hull 86 is slightly less than half the width of the deck 12, but is greater than the combined width of the two side pods 16, 18. An internal volume of the central hull 86 (without any components inside of it) is greater than the combined internal volume of the four sub-pods 16A, 16B, 18A, 18B. In one implementation, the internal volume of the central hull 86 is about forty percent greater than the combined internal volume of the four sub-pods 16A, 16B, 18A, 18B. As can be seen in FIG. 6, the transom deadrise angle 116 of the central hull 86 taken along location C (FIG. 4) is less than the transom deadrise angles 70 of the rear sub-pods 16B, 18B and therefore of the side pods 16, 18. Also, the deadrise angle of the central hull 86 increases from the transom 94 to the bow 92. For example, the deadrise angle taken at location B (FIG. 4) is about 102% of the transom deadrise angle 116 taken along location C and the deadrise angle taken at location A (FIG. 4) is about 106% of the transom deadrise angle 116 taken along location C.

The collar 88 is a structural component that is used to connect the central hull 86 to the bottom of the deck 12 and to prevent the entry of water into the central hull 86. The collar 88 has a bottom, inwardly extending, flange (not shown) connected to the upper edge of the central hull 86 by fasteners and/or an adhesive, a vertical wall 118 (FIG. 17) that extends vertically from the bottom flange and an upper, outwardly extending, flange 120 (FIG. 17) connected to the bottom of the deck 12 by fasteners and/or an adhesive. It is contemplated that the collar 88 could be integrally formed with the central hull 86. It is also contemplated that the collar 88 could be made of multiple parts. It is also contemplated that the collar 88 could be replaced by a plurality of legs, posts or brackets for structurally connecting the central hull 86 to the bottom of the deck 12 and by a ring of waterproof material or some other non-structural component connected between the central hull 86 and the bottom of the deck 12 to prevent the entry of water inside the central hull 86.

The height of the collar 88 determines the vertical position of the central hull 86 with respect to the deck 12. As can be seen in FIG. 5, the distance between the central hull 86 and the bottom of the deck 12 is selected such that the central keel 96 of the central hull 86 is lower than the keels 64 of the side pods 16, 18. In some implementations, with reference to FIG. 4, the height of the collar 88 is selected such that the vertical distance D between the keels 64 of the side hulls 56 of the front side sub-pods 16A, 18A and the keel 96 of the central hull 86 in a vertical plane passing trough location A (corresponding to the point of the keel 96 that is furthest from the bottom surface of the main portion 30 of the deck 12) is between about ⅛ and 5⁄16 of the vertical distance E between the keels 64 of the side hulls 56 of the front side sub-pods 16A, 18A and the bottom surface of the main portion 30 of the deck 12 in the vertical plane passing through location A. Also, as shown in FIG. 6, the vertical position of the central keel 96 and the transom deadrise angle 116 of the central hull 86 are selected such that lines 122 extending from the central keel 96 at the transom deadrise angle 116 of the central hull 86 intersect the vertical planes 68 passing through the keels 64 of the side pods 16, 18 at a point vertically between the top of their corresponding pods 16, 18 and their corresponding keels 64. In some implementations, the height of the collar 88 is selected such that the greatest vertical distance between the keel 96 of the central hull 86 and the bottom surface of the main portion 30 of the deck 12 (i.e. the sum of distances D and E in FIG. 4) is between about 30% and 35% of the lateral distance between the two keels 64 of the front left and right hulls 56 of the front left and right sub-pods 16A, 18A. Also, as will be described below, some of the components of the central pod 14, such as the engine 46, extend above the top edge of the central hull 86. The height of the collar 88 is also selected such that such components are vertically below the bottom of the deck 12, as can be seen in FIG. 5 for the engine 46.

As best seen in FIG. 7, the collar 88 connects the central hull 86 to the deck 12 at a position that is laterally centered with respect to the deck 12 between the side pods 16, 18. The deck 12 extends forward and rearward of the central pod 14, but the central pod 14 is disposed closer to the rear of the deck 12 than the front of the deck 12. The trap door 44 is located on the deck 12 so as to be aligned, at least partially, with the location of the engine 46 in the central hull 86. The stern of the central pod 14 is located forward of the stern of the rear side sub-pods 16B, 18B. The front of the central pod 14 is located rearward of the front of the front side sub-pods 16A, 18A but forward of the stern of the front side sub-pods 16A, 18A. The front of the central pod 14 is longitudinally located at the rear of the raised portion of the bottom of the deck 12.

Figure 17:
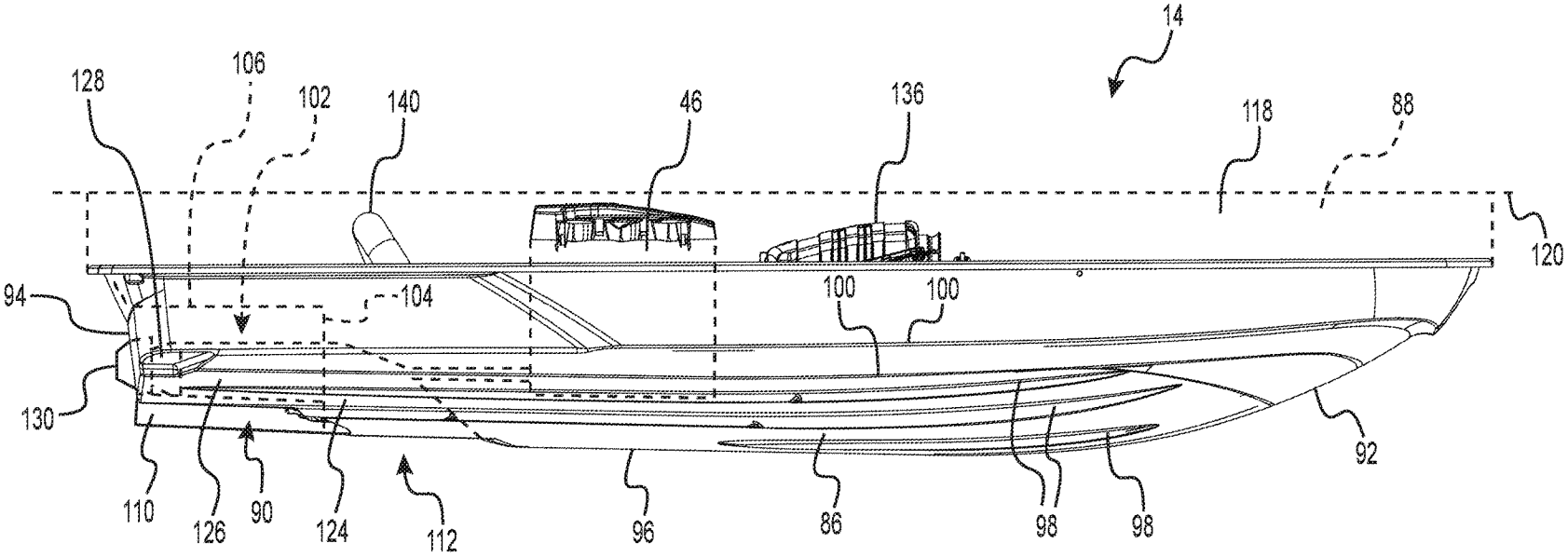
FIG. 17 is a right side elevation view of a central pod of the watercraft of FIG. 1, with a collar of the central pods shown in dotted lines.

As can be seen in FIGS. 17 and 18, the jet propulsion system 90 is disposed in part in the central tunnel 102 of the central hull 86. The jet propulsion system 90 has an intake ramp 124, a jet pump 126, a venturi 128 and a steerable nozzle 130. The intake ramp 124 extends upward and rearward from the water inlet 112. The top portion of the intake ramp 124 is defined by the central hull 86. The jet pump 126 is disposed in the tunnel 102 and is mounted to the front wall 104 of the tunnel 102.

The jet pump 126 includes an impeller (not shown) and a stator (not shown). The impeller is connected to and driven by the engine 46 by a driveshaft 132 (FIG. 18). The venturi 128 is connected to the outlet of the jet pump 126. The outlet of the venturi 128 has a smaller diameter than the inlet of the venturi 128. The steerable nozzle 130 is pivotally connected about a vertical steering axis to the venturi 128. The rear end of the steerable nozzle 130 is disposed forward of the rear end of the deck 12. During operation, the engine 46 turns the impeller of the jet pump 126. As a result, water flows through the water inlet 112 into the intake ramp 124, then through the jet pump 126 where it is pressurized. The water then flows through the venturi 128 which accelerates the water further and then flows through the steerable nozzle 130. The steerable nozzle 130 is operatively connected to the handlebar 54 such that when the handlebar 54 is turned, the steerable nozzle 130 also turns. When the steerable nozzle 130 turns, it redirects the jet of water expelled from the venturi 128 thereby causing the watercraft 10 to steer in the corresponding direction. In one implementation, the steerable nozzle 130 is mechanically connected to the handlebar 54 by a push-pull cable for example. In an alternative implementation, a sensor senses a position of the handlebar 54 and an actuator, such as an electric motor, steers the steerable nozzle 130 in response to the signal received from the sensor. In an alternative implementation, the steerable nozzle 130 is gimbaled such that it can also pivot about a horizontal axis to trim the watercraft 10. It is also contemplated that the jet propulsion system 90 could also be provided by a reverse gate used to selectively redirect water expelled from the steerable nozzle 130 toward a front of the watercraft 10 to cause the watercraft 10 to move rearward. It is also contemplated that the reverse gate could be adapted to permit the reverse gate to be used to decelerate the watercraft 10.

As can be seen in FIG. 18, the engine 46 is connected in the central hull 86 at a position forward of the jet propulsion system 90 and rearward of a fuel tank 134. The top of the engine 46 is disposed above the top edge of the central hull 86. The fuel tank 134 supplies fuel to the fuel injection system (not shown) of the engine 46. It is contemplated that the fuel injection system could be replaced by a carburetor. The top of the fuel tank 134 is disposed below the top edge of the central hull 86. An air box 136 is disposed on top of and connected to the fuel tank 134 forward of the engine 46. The air box 136 supplies air to the engine 46. The top of the air box 136 is disposed above the top edge of the central hull 86. It is contemplated that the air box 136 could alternatively be connected to the engine 46 or the central hull 86. It is contemplated that the air box 136 could be omitted and replaced by an air filter connected to an inlet of a throttle body (not shown) of the engine 46. The exhaust gases generated by the engine 46 flow from the engine 46 through two mufflers 138 and then into the tunnel 102. A pipe 140 connecting the two mufflers 138 together extends above the top edge of the central hull 86. In the present implementation, the engine 46 is a four-stroke, fuel injected, three-cylinder, inline, internal combustion engine. It is contemplated that other types of engines could be used, such as a two-stroke, carbureted, two-cylinder, V-type, internal combustion engine. It is also contemplated that the engine 46 could be replaced by another type of motor. For example, the internal combustion engine 46 could be replaced by an electric motor, in which case the fuel tank 134, the air box 136 and the mufflers would be omitted and replaced by a battery pack to power the electric motor. The central pod 14 is provided with other components for the proper operation of the engine 46 such as a battery, a starter motor and bilge pumps, but these will not be described in detail herein. It should be understood that these are nonetheless present.

To allow the fuel tank 134 to be filled, a fuel filler neck 142 (FIG. 6) extends from the fuel tank 134, through an aperture 144 (FIG. 9) in the bottom of the deck 12, through the main portion 30 of the deck 12, into the left gunnel 34 and opens at a front portion of the left gunnel 34. A fuel cap 146 closes the opened end of the fuel filler neck 142 on the left gunnel 34.

To ventilate the volume defined between the hull 86, the collar 88 and the bottom of the deck 12 and to provide air to the air box 136 a ventilation hose 148 (FIG. 6) is provided. The hose 148 extends from the inside of the hull 86, through an aperture 150 (FIG. 9) in the bottom of the deck 12, through the main portion 30 of the deck 12, into the right gunnel 34 and opens at a rear portion of the right gunnel 34. A grate 152 is provided over the opened end of the hose 148 on the right gunnel 34 to prevent large debris from entering the hose 148. It is contemplated that more than one ventilation hose 148 could be provided.

Turning now to FIGS. 19 to 39, a watercraft 210, which is an alternative implementation of the watercraft 10 described above, will be described.

As can be seen in FIGS. 19 to 25, the watercraft 210 has a deck 212, a central pod 214, a left pod 216 and a right pod 218. The pods 214, 216, 218 are connected to a bottom of the deck 212 as will be described in greater detail below. The central pod 214 is laterally centered relative to the deck 212. The left and right pods 216, 218 are disposed to the left and right of the central pod 214 respectively. The pods 214, 216, 218 buoyantly support the deck 212 above water.

Figure 22:
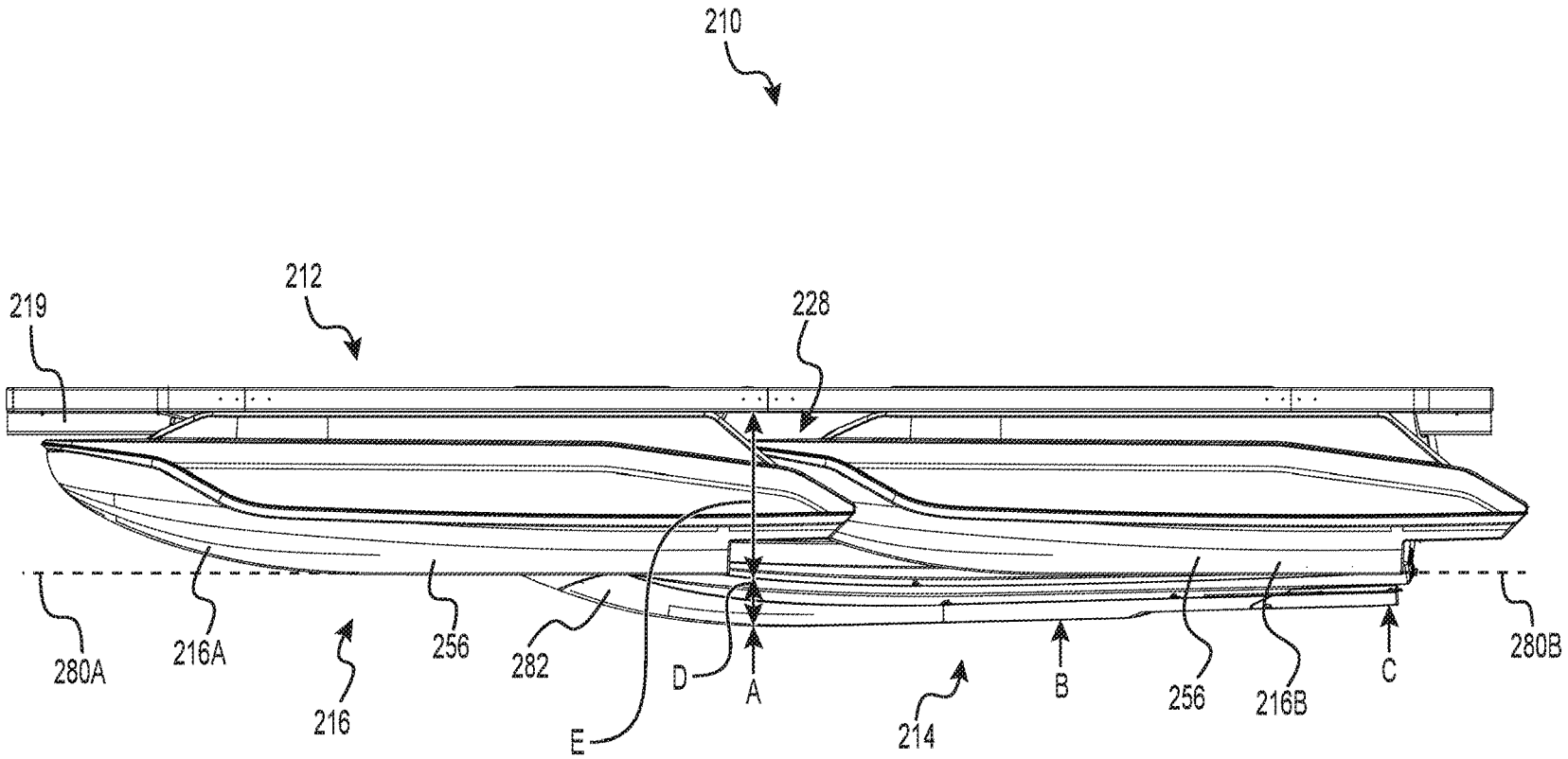
FIG. 22 is a left side elevation view thereof.

The left pod 216 is made of a front sub-pod 216A and a rear sub-pod 216B disposed rearward of the front sub-pod 216B and being laterally aligned therewith. Similarly, the right pod 218 is made of a front sub-pod 218A and a rear sub-pod 218B disposed rearward of the front sub-pod 18B and being laterally aligned therewith. It is contemplated that each of the left and right pods 216, 218 could be formed by a single pod or by more than two sub-pods. The sub-pods 216A, 216B, 218A, 218 are connected to the bottom of the deck 212. As best seen in FIG. 22 for the left sub-pods 216A, 216B, the sub-pods 216A, 216B, 218A, 218B are shaped such that the front and rear of each sub-pod 216A, 216B, 218A, 218B are spaced from the bottom of the deck 212.

Figure 23:
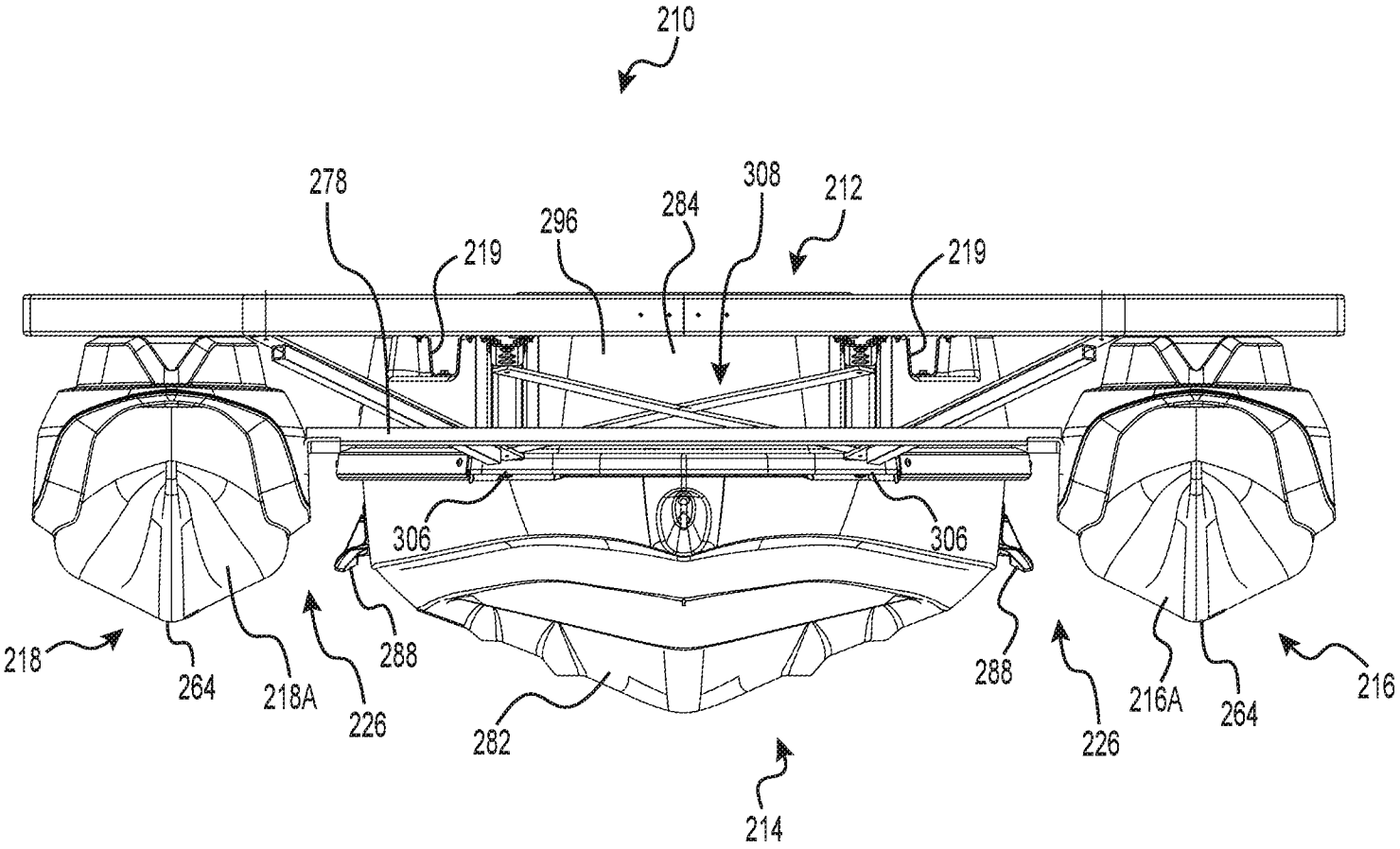
FIG. 23 is a front elevation view thereof.
Figure 24:
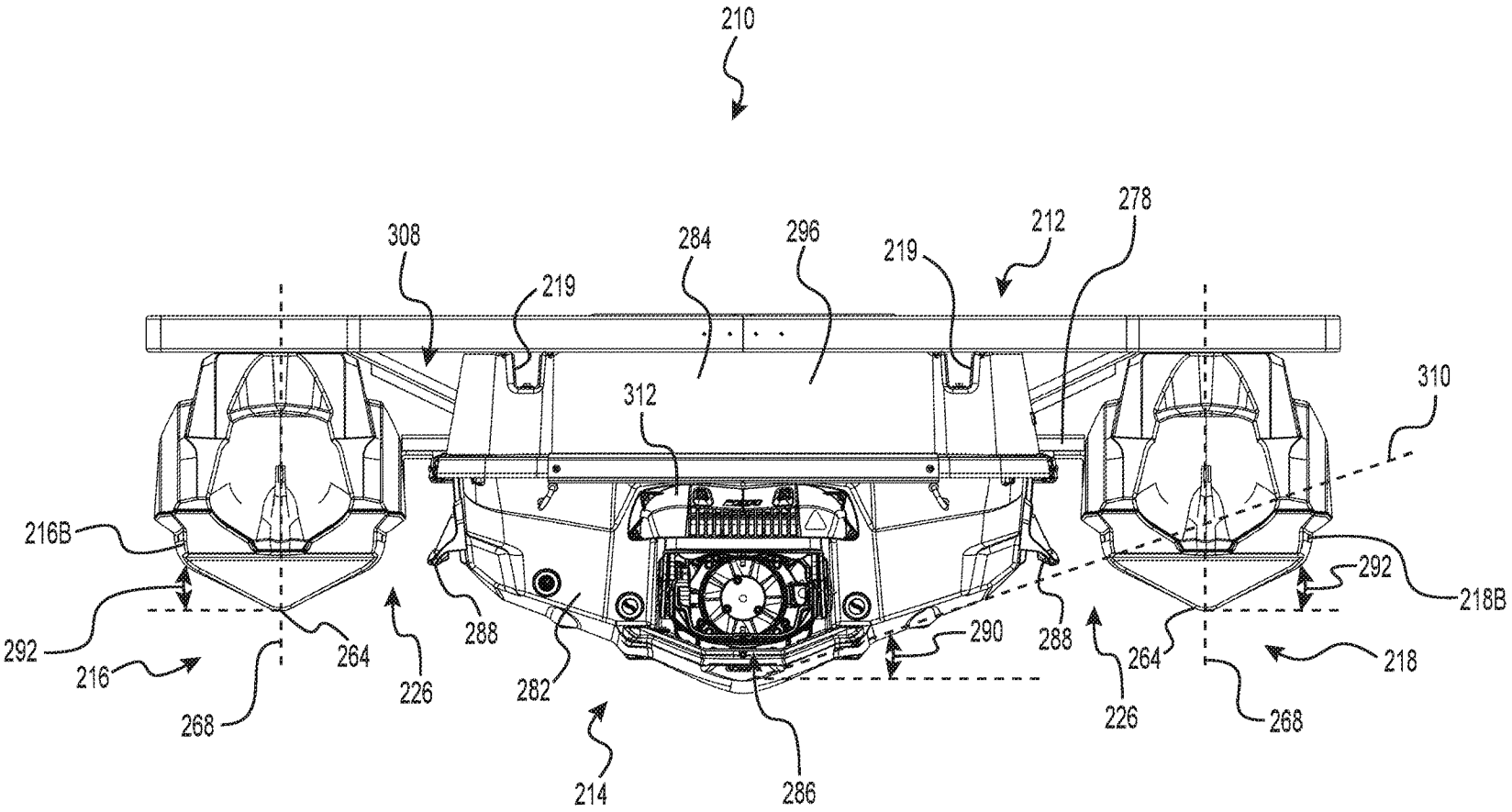
FIG. 24 is a rear elevation view thereof.

As can be seen in FIGS. 23 and 24, the watercraft 210 has left and right channels 226 defined between the pods 214, 216, and 218 permitting the passage of water below the deck 212. More specifically, the left channel 226 is defined between the right side of the left pod 216, the left side of the central pod 214 and the portion of the deck 212 disposed laterally between the central and left pods 214, 216. The left channel 226 extends along an entire length of the central pod 214. Similarly, the right channel 226 is defined between the left side of the right pod 218, the right side of the central pod 214 and the portion of the deck 212 disposed laterally between the central and right pods 214, 218. The right channel 226 extends along an entire length of the central pod 214. In order to permit the evacuation of some of the water flowing in the channels 226, side passages 228 are defined in part by the pods 216, 218. More specifically, as can be seen in FIG. 22 the left side passage 228 is defined longitudinally between the portions of the front and rear sub-pods 216A, 216B connecting the sub-pods 216A, 216B to the deck 212 and vertically between the top of the front portion of the rear sub-pod 216B and the bottom of the deck 212. The right side passage 228 is similarly defined by the sub-pods 218A, 218B and the deck 212 on the right side of the watercraft 210. During operation of the watercraft 210, some of the water flowing in the channels 226 will flow through the passages 228 to the outside of the watercraft 210 on the left of the left pod 216 and on the right of the right pod 218.

The pods 216A, 216B, 218A, 218B will be described in greater detail further below with respect to FIGS. 32 to 36.

Figure 25:
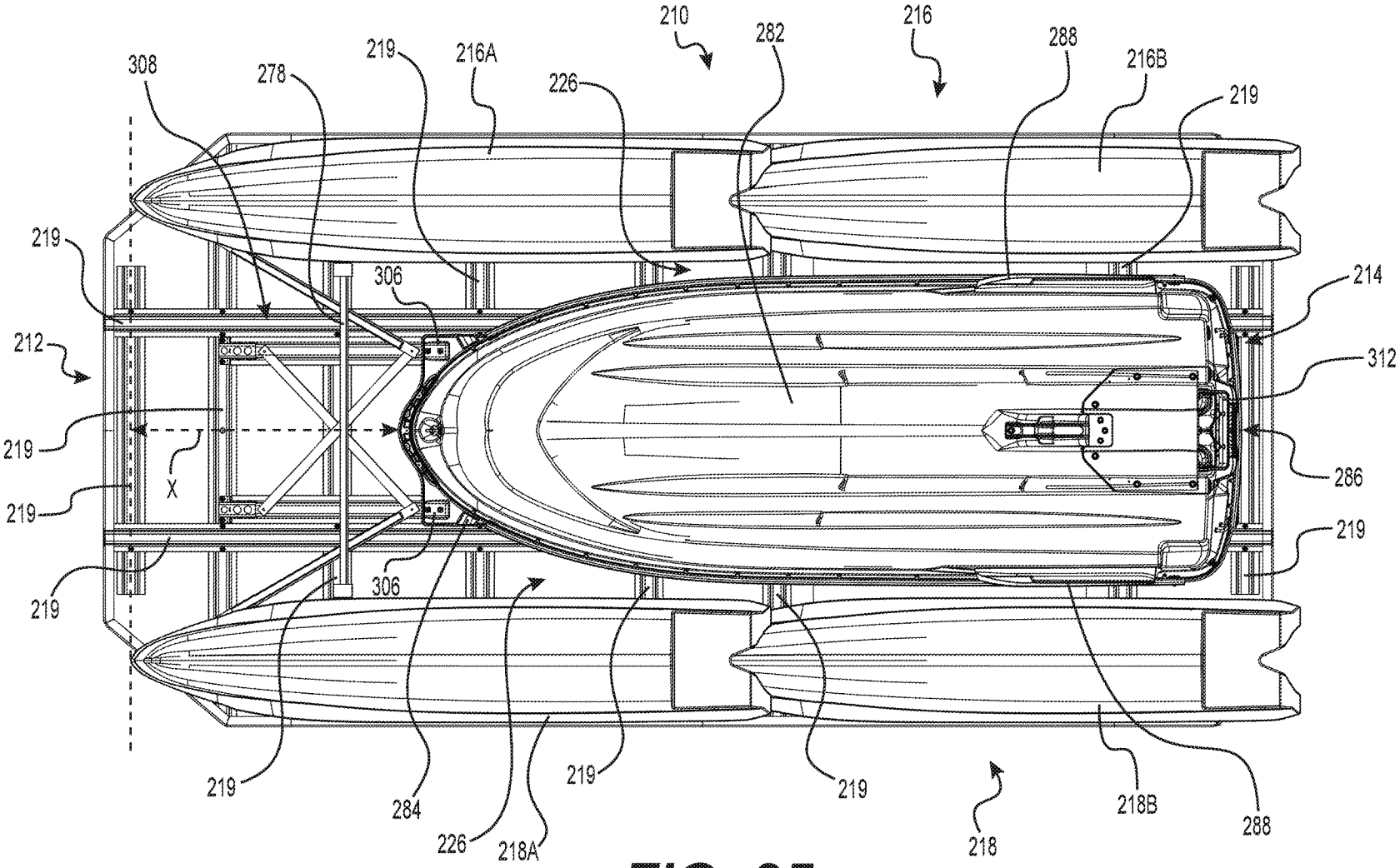
FIG. 25 is a bottom plan view thereof.
Figure 26:
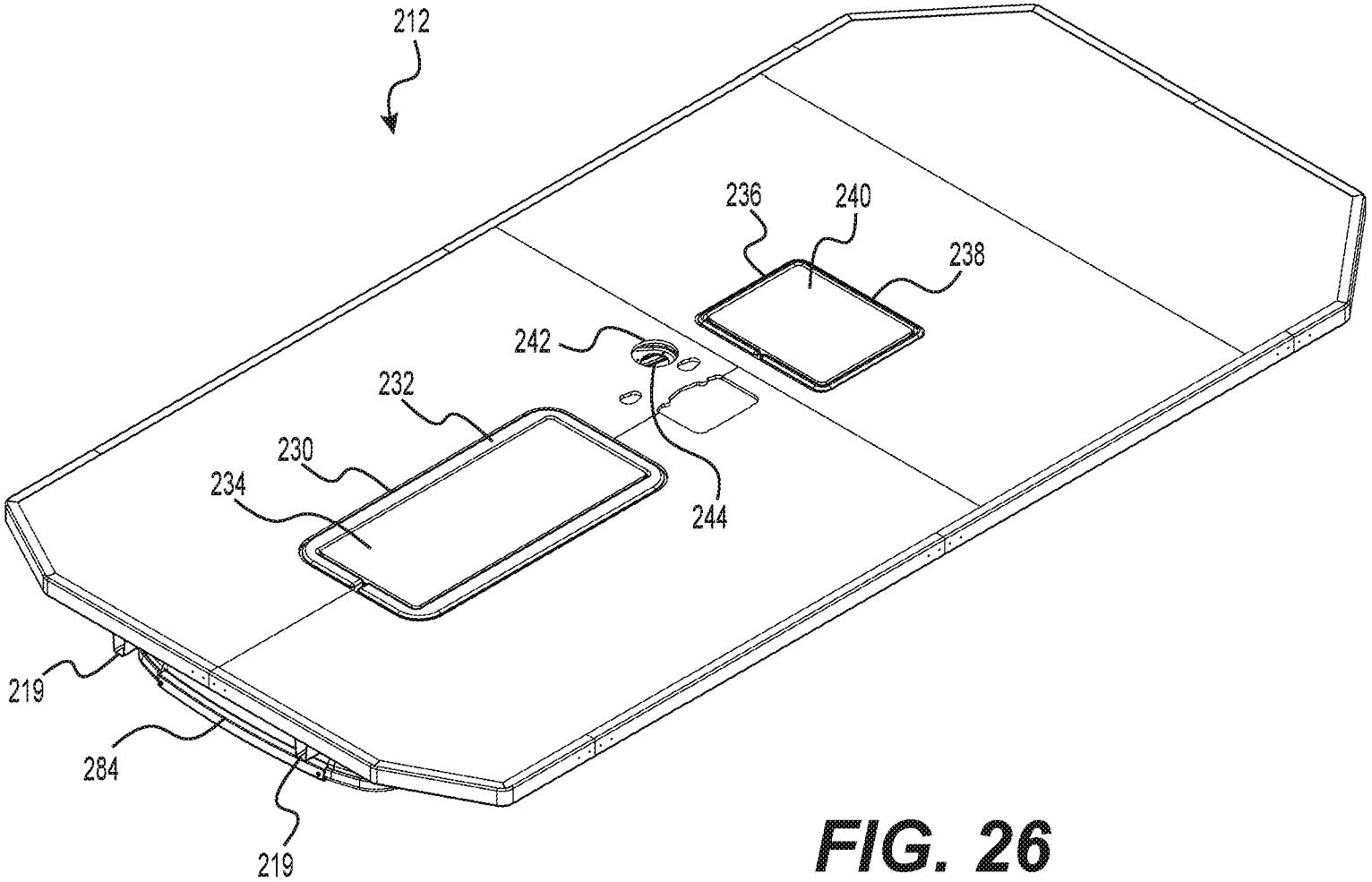
FIG. 26 is a perspective view taken from a rear, right side of a deck and a cap of a central pod of the watercraft of FIG. 1.
Figure 27:
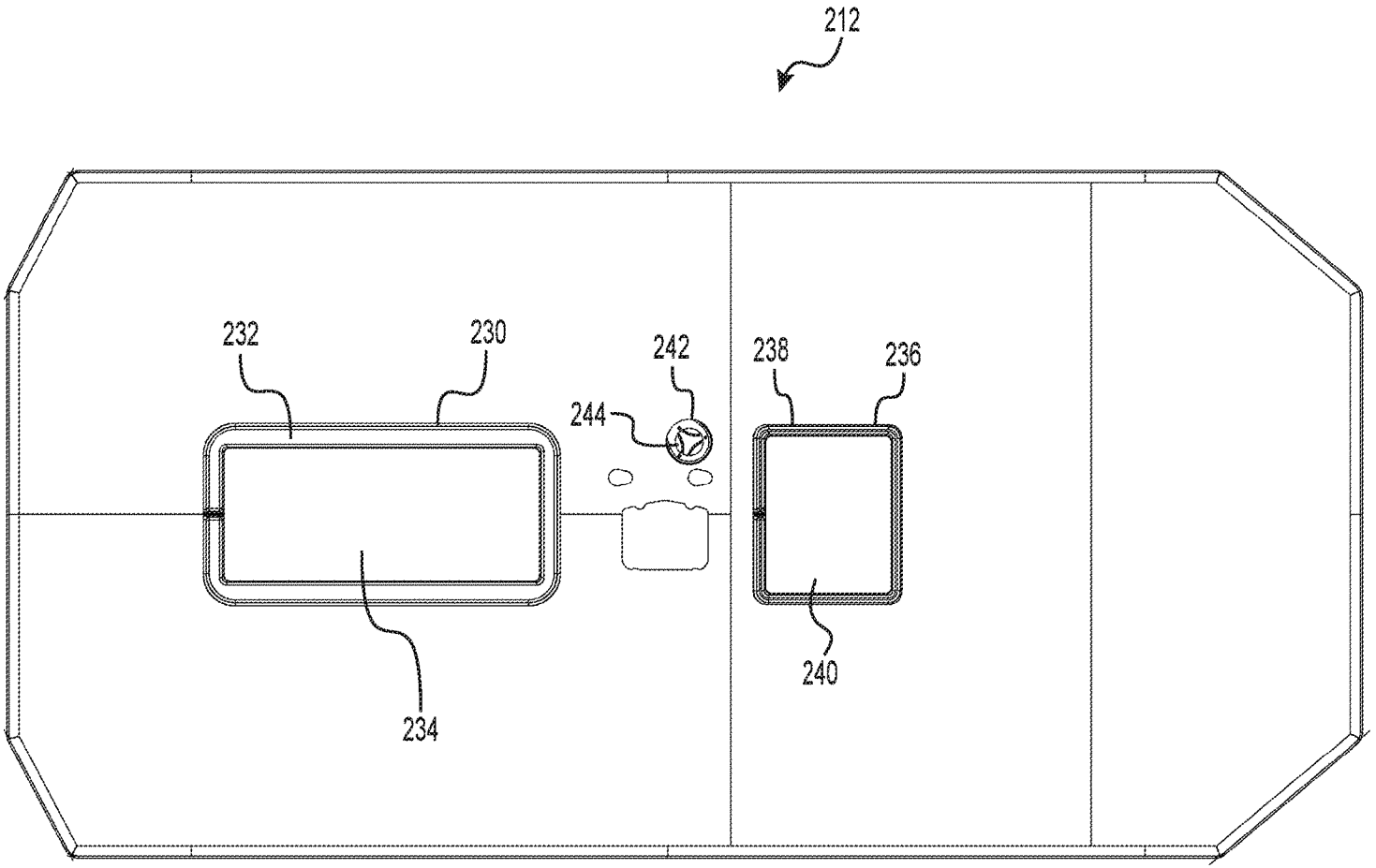
FIG. 27 is a top plan view of the deck and cap of FIG. 26.

Turning now to FIGS. 26 to 31, the deck 212 will be described in greater detail. In the present implementation, the deck 212 has a flat top surface and has the shape of a rectangle with cut corners (as viewed from above, FIG. 27). In the present implementation, the deck 212 has substantially the same length as the side pods 216, 218. More specifically, in the present implementation, the deck 212 is 4.57 meters long (15 feet), but it is contemplated that it could be longer or shorter. As best seen in FIG. 25, the side pods 216, 218 are positioned under the deck 212 such that the front of the side pods 216, 218 extend forward of the front cut corners of the deck 212 but are disposed rearward of the front of the deck 212 and the rear of the side pods 216, 218 extend rearward of the rear of the deck 212. It is contemplated that the side pods 216, 218 could be located more forward or rearward than illustrated. The deck 212 is sufficiently wide to accommodate all three pods 214, 216, 218 between its side edges while leaving space to for the channels 216. In the present implementation, the width of the deck 212 is about half the length of the deck 212. In the present implementation, the deck 212 is 2,276 meters wide (7.47 feet), but it is contemplated that it could be wider or narrower. The deck 212 extends forward and rearward of the central pod 214. As can be seen in FIG. 25, the central pod 214 is disposed closer to the rear of the deck 212 than to the front of the deck 212. It is contemplated that the central pod 214 could be located more forward or rearward than illustrated.

Figure 28:
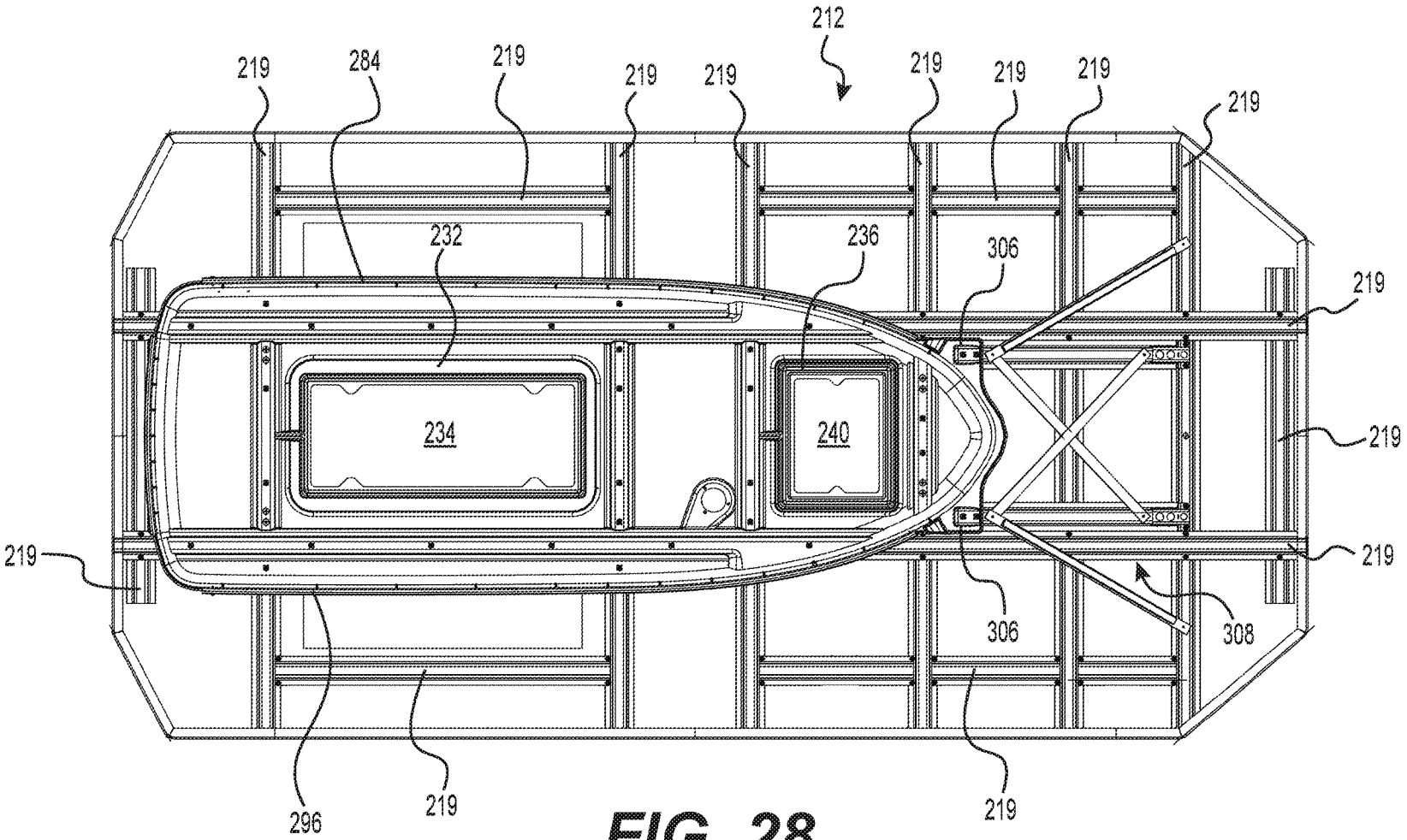
FIG. 28 is a bottom plan view of the deck and cap of FIG. 26.
Figure 29:
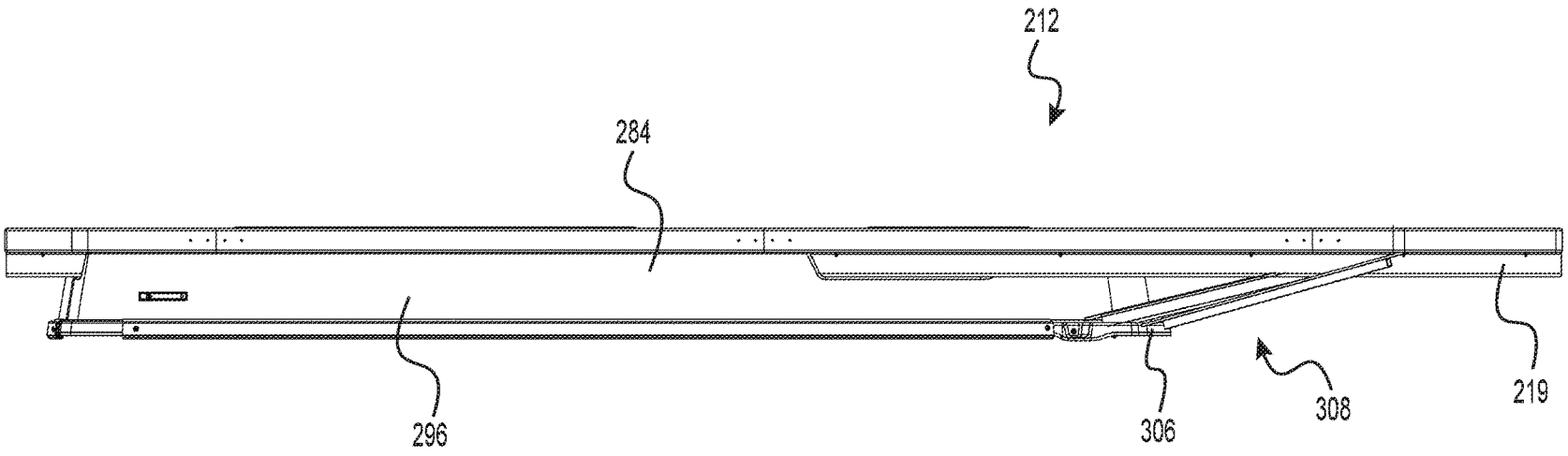
FIG. 29 is a right side elevation view of the deck and cap of FIG. 26.
Figure 30:
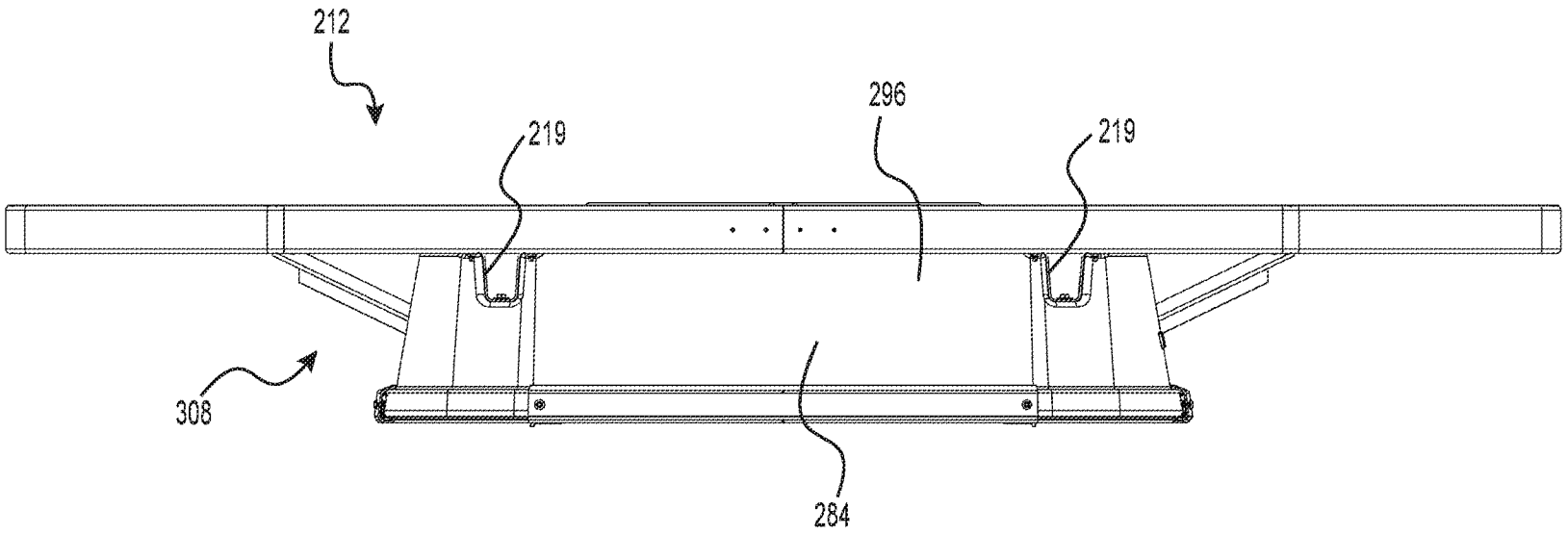
FIG. 30 is a rear elevation view of the deck and cap of FIG. 26.
Figure 31:
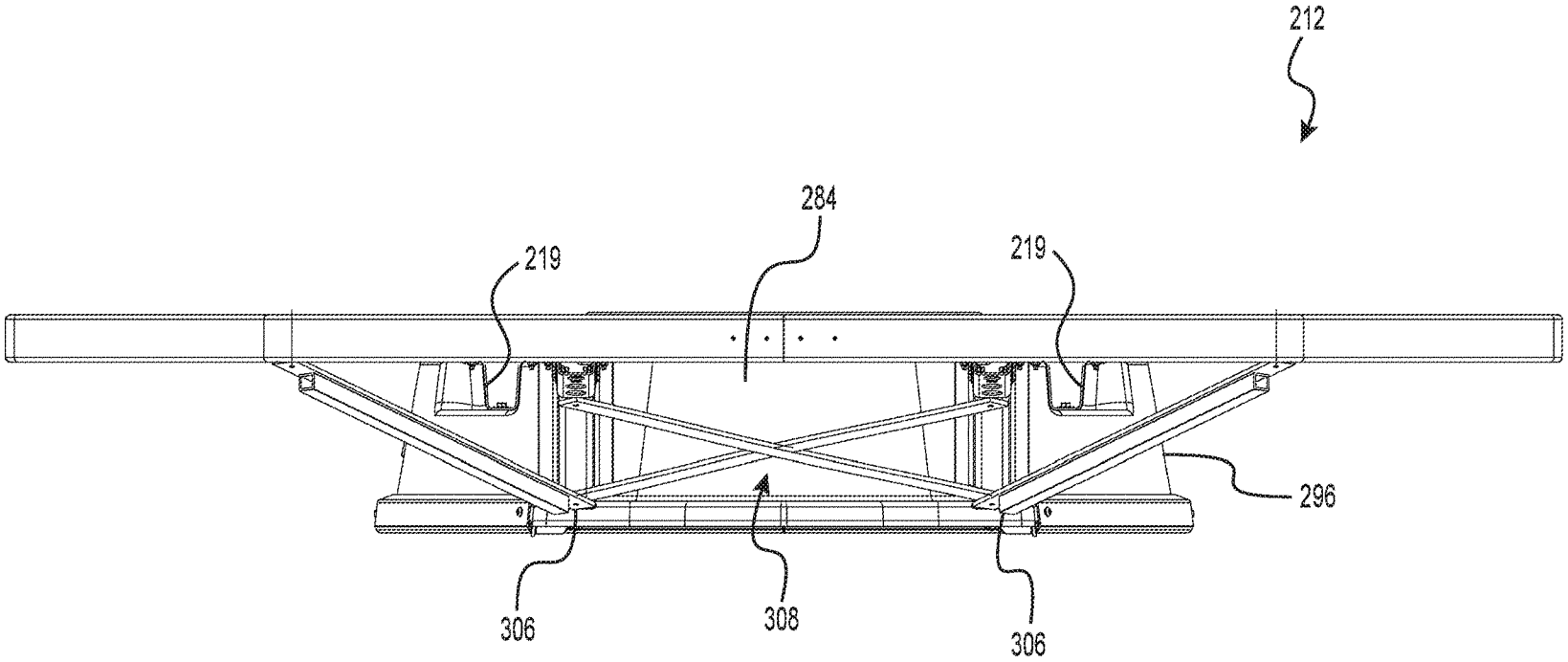
FIG. 31 is a front elevation view of the deck and cap of FIG. 26.

As best seen in FIG. 28, the top portion of the deck 212 is reinforced by a number of longitudinal and lateral metal ribs 219 fastened to the bottom thereof. The ribs 219 form a grid-like frame structure. It is contemplated that the ribs 219 could be omitted. For example, the deck 212 could be formed by a plastic or composite material outer skin having a foam and/or honeycomb core that is sufficiently strong so as not to require the ribs 219.

Figure 37:
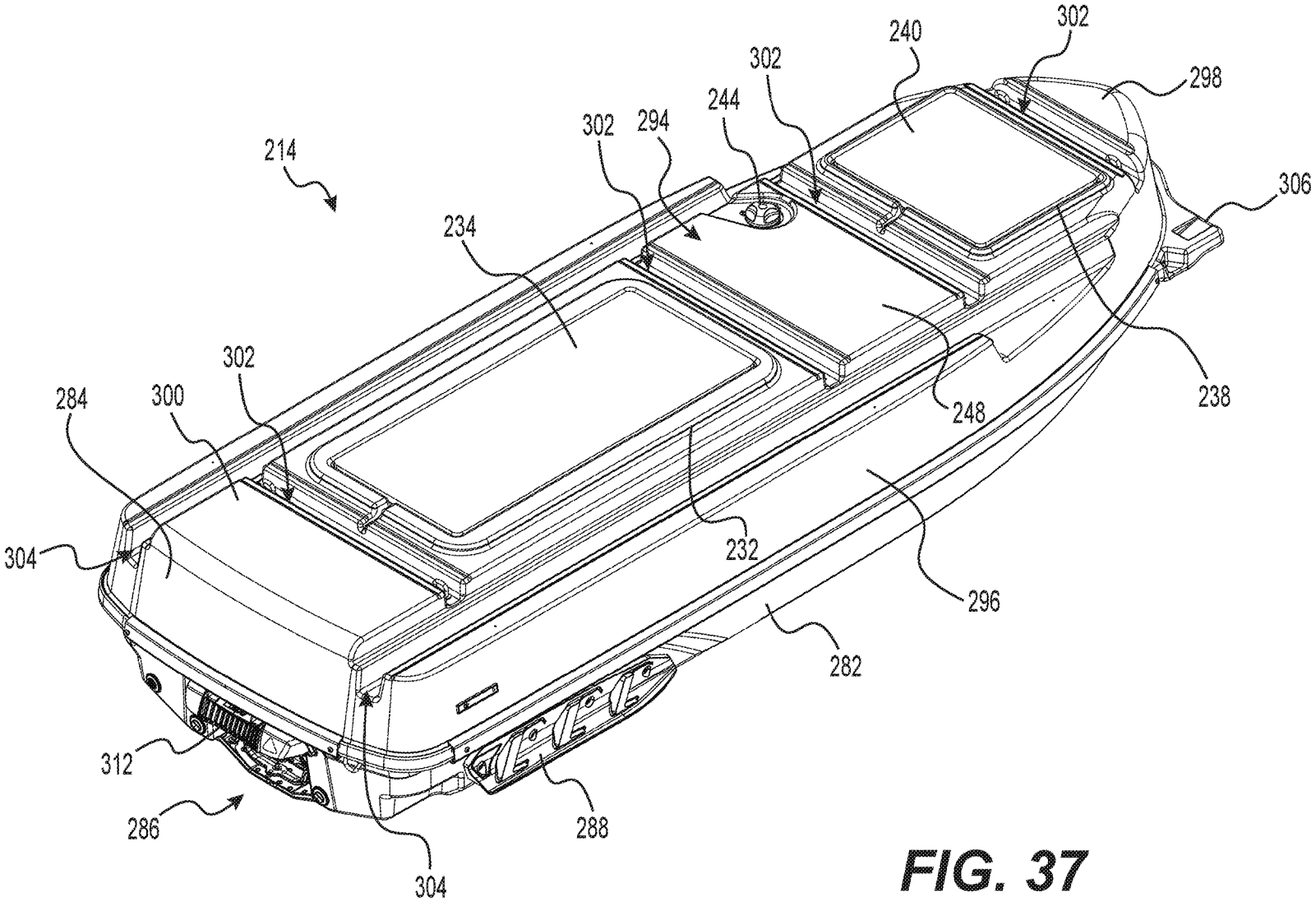
FIG. 37 is a perspective view taken from a rear, right side of a central pod of the watercraft of FIG. 19.
Figure 39:
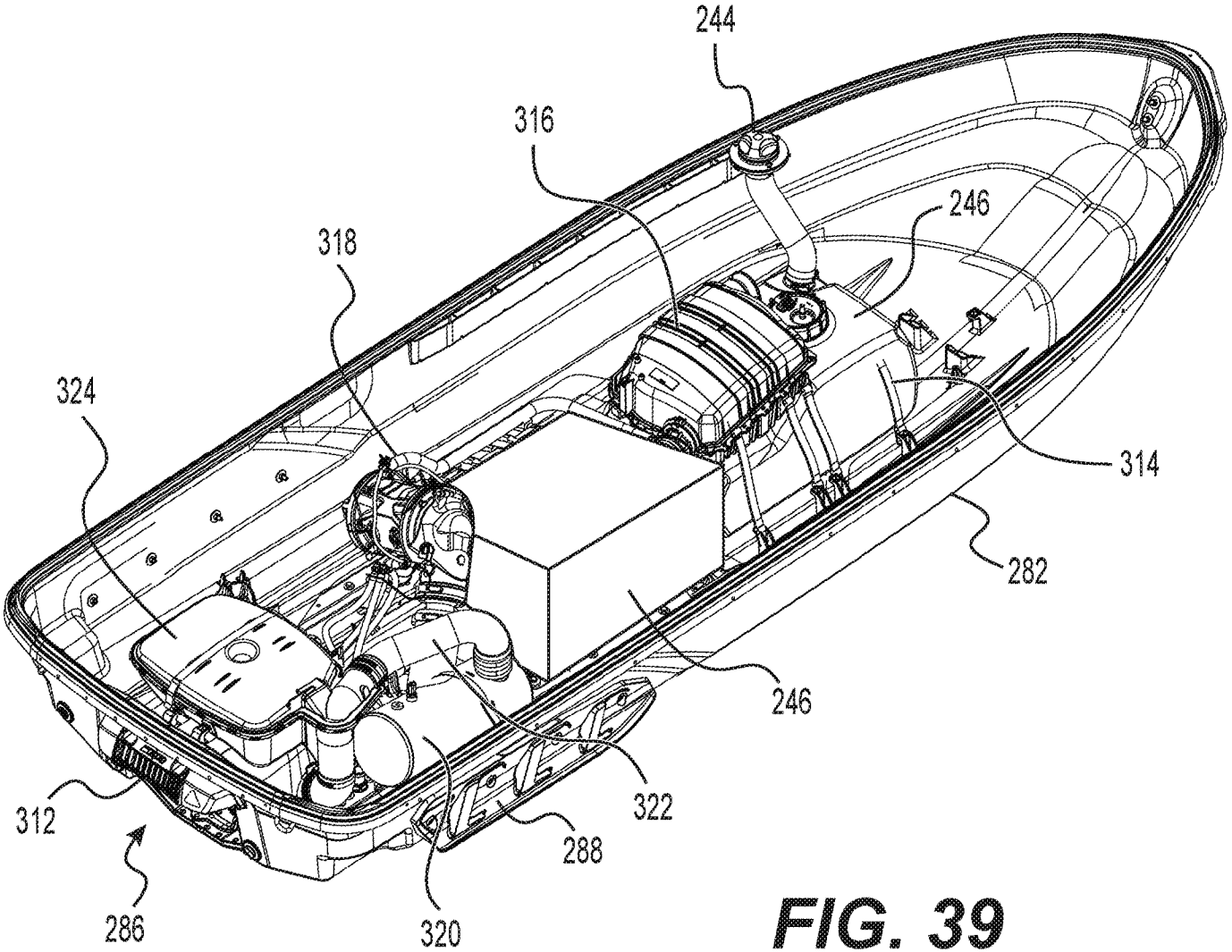
FIG. 39 is a perspective view taken from a rear, right side of the central pod of FIG. 37, without the cap.

A generally rectangular aperture 230 is defined in the deck 212. The aperture 230 receives a raised portion 232 of the central pod 214 therein. The raised portion 232 has a shape corresponding to the shape of the aperture 230. A trap door 234 is provided in the raised portion 232. The trap door 234 provides access to components of the central pod 214 such as the engine 246 (FIG. 39). Another generally rectangular aperture 236 is defined in the deck 212 forward of the aperture 230. The aperture 236 receives a raised portion 238 of the central pod 214 therein. The raised portion 238 has a shape corresponding to the shape of the aperture 236. A trap door 240 is provided in the raised portion 238. The trap door 240 provides access to a storage compartment (not shown) defined in the central pod 214. It is contemplated that aperture 236, the raised portion 238, the trap door 240 and its corresponding storage compartment could be omitted. It is contemplated that he trap doors 234 and 240 can be hinged to or removable from their corresponding raised portions 232, 238. A circular aperture 242 is defined in the deck 212 between the apertures 230, 236 to provide access to a fuel cap 244 of a fuel tank 246 (FIG. 39) disposed in the central pod 214. The fuel cap 244 is provided on top of another raised portion 248 (FIG. 37) of the central pod 214. The raised portion 248 is disposed longitudinally between the raised portions 232, 238 as can be seen in FIG. 37.

Figure 19:
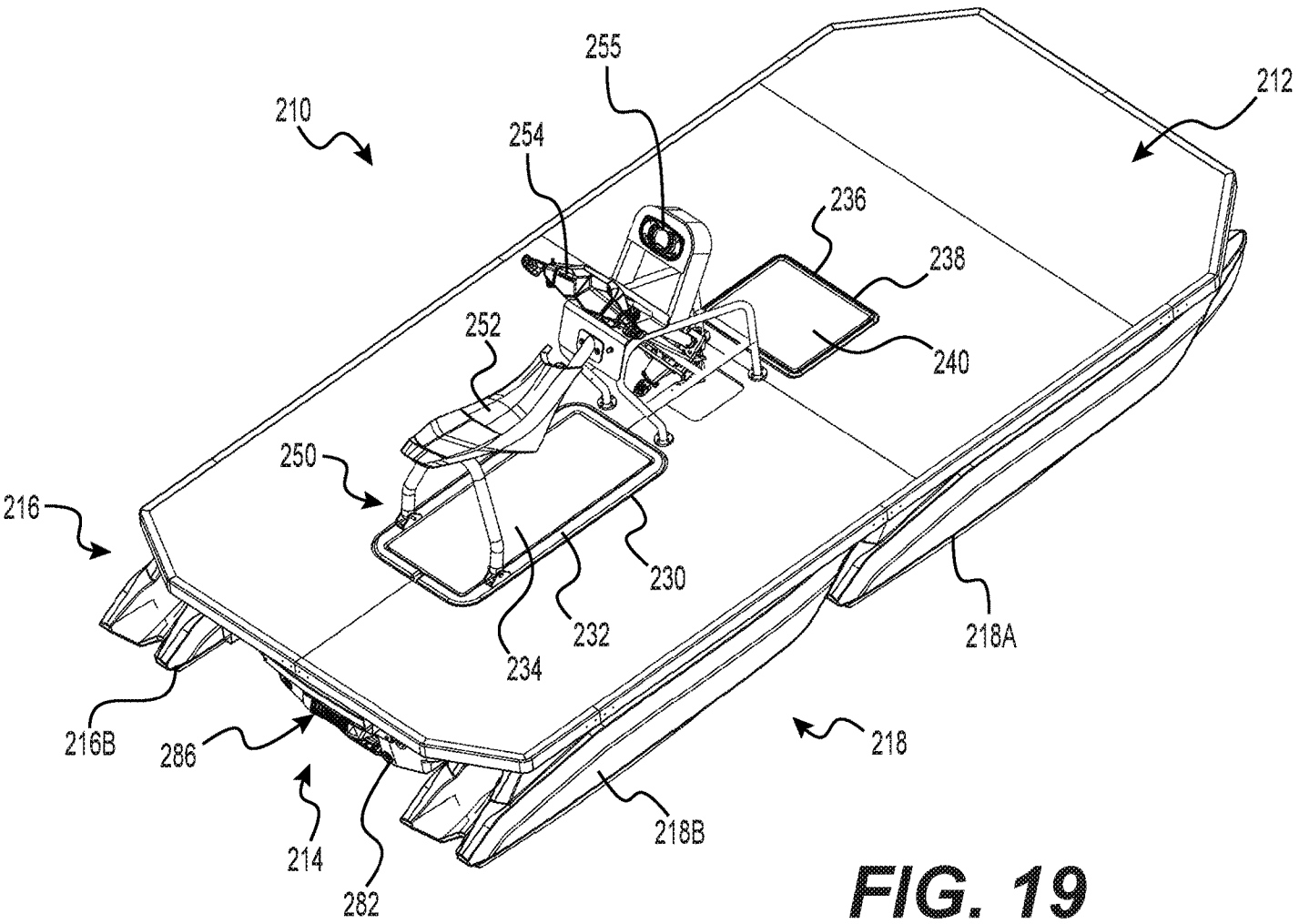
FIG. 19 is a perspective view taken from a rear, right side of an alternative implementation of a watercraft.
Figure 20:
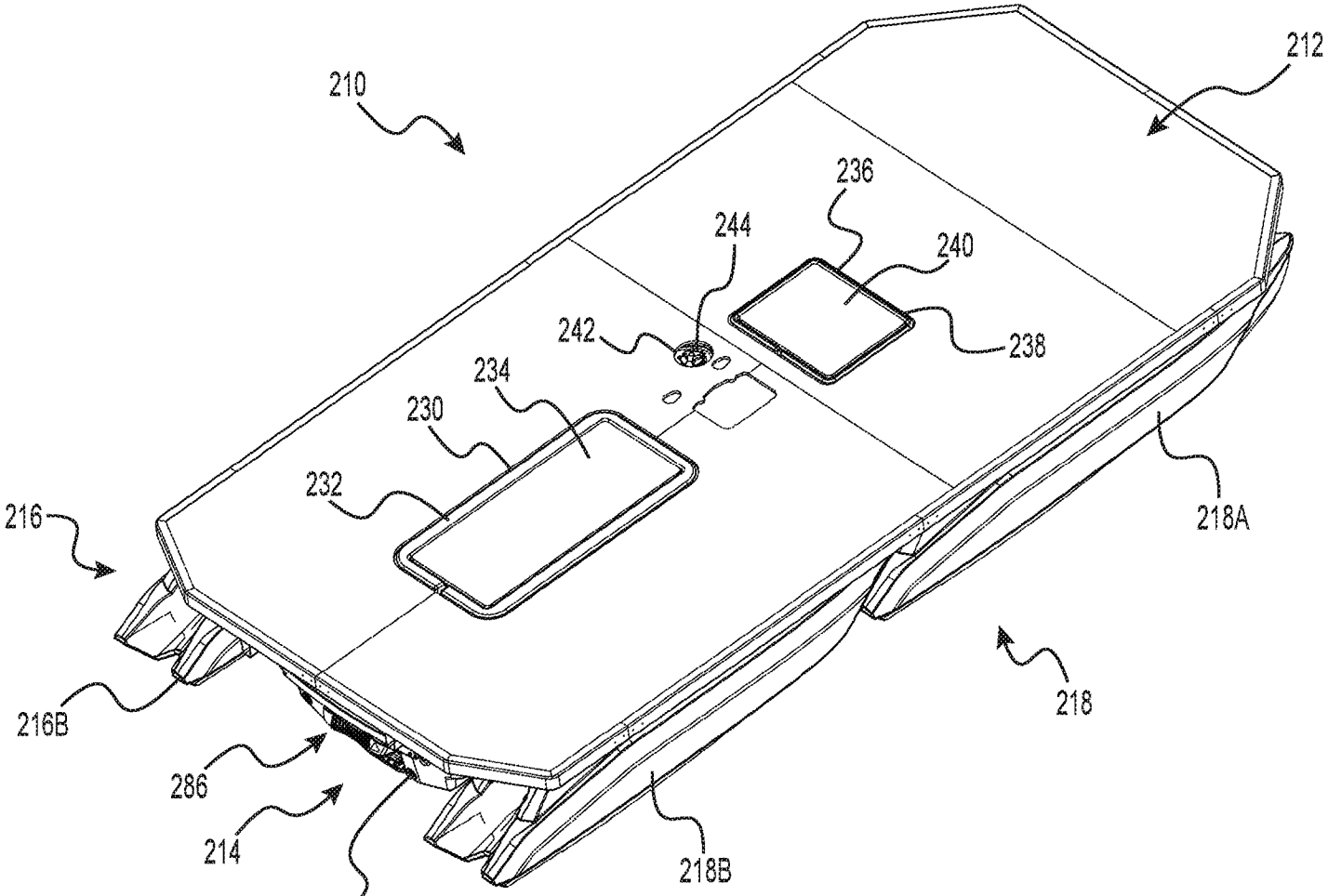
FIG. 20 is a perspective view taken from a rear, right side of the watercraft of FIG. 19, with a seat and helm assembly removed.
Figure 21:
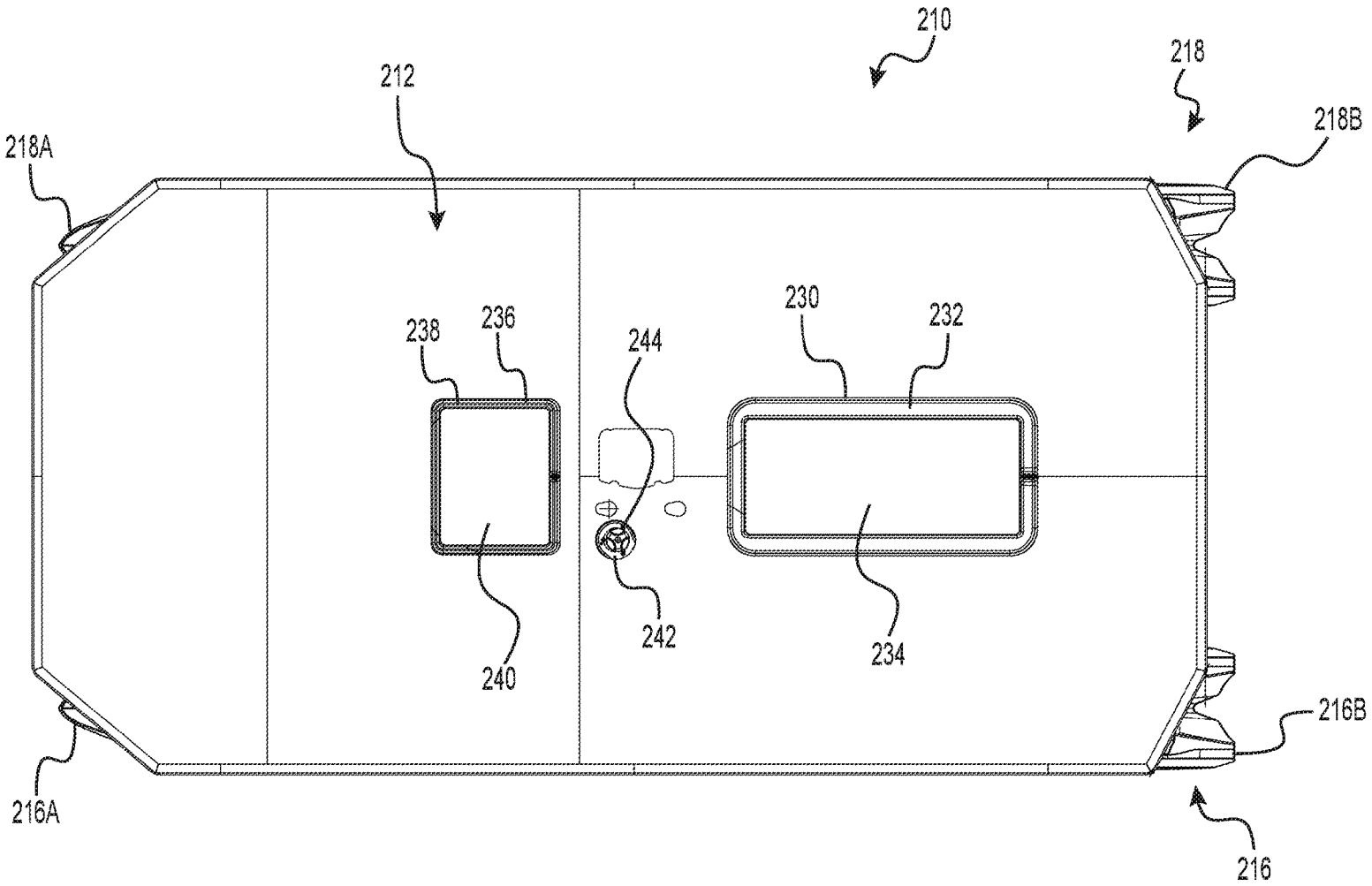
FIG. 21 is a top plan view thereof.

As can be seen in FIG. 19, a tubular frame structure 250 is mounted to the top of the deck 212. The tubular frame structure 250 is disposed in part above the trap door 234, rearward of the trap door 240 and is laterally centered on the deck 212. A straddle seat 252 is connected to the tubular frame structure 250. A helm assembly including a handlebar 254 is supported by the tubular frame structure 250 forward of the straddle seat 252 to permit steering of the watercraft 210. A throttle lever (not shown) is provided on the handlebar 254 to control a speed of the watercraft 210. A display cluster 255 is connected to the tubular frame structure 250 forward of the handlebar 254. It is contemplated that the straddle seat 252 could be replaced by a bucket seat, a bench or another type of seat that may or may not require the tubular frame structure 250 or may require a different type of supporting structure. It is also contemplated that additional seats could be provided on the deck 212. It is contemplated that the tubular frame structure 250 could be replaced by another type of structure for supporting the seat 252, the handlebar 254 and the display cluster 255. It is also contemplated that the handlebar 254 could be replaced by a steering wheel, a joystick or other steering input device. It is also contemplated that other structures such as guard rails, gunnels, storage and a wakeboard tower for example could be provided on the deck 212.

Turning now to FIGS. 32 to 36, the front left sub-pod 216A will be described in greater detail. In the present implementation, the rear left sub-pod 216B, the front right sub-pod 218A and the rear right sub-pod 218B are identical to the front left sub-pod 216A. It is contemplated that the sub-pods 216A, 216B, 218A and 218B could differ cosmetically and/or aesthetically and/or by minor structural difference, such as the addition of apertures to mount a bracket on one or more of the sub-pods 216A, 216B, 218A and 218B, without affecting their intended functionality, in which case they are referred to herein as being substantially identical to each other. Sub-pods 216A, 216B, 218A and 218B made from identical molds but modified following the molding process are considered as being substantially identical to each other. It is also contemplated that the sub-pods 216A, 216B, 218A, 218B could not be identical to each other. For example, it is contemplated that the two front sub-pods 216A and 218A could be identical to each other and that the two rear sub-pods 216B and 218B could be identical to each other but different from the front sub-pods 216A and 218A. It is also contemplated that the left sub-pods 216A and 216B could be mirror images of the right sub-pods 218A and 218B. Although only the front left sub-pod 216A is described in detail below, in order to differentiate between corresponding elements of the various sub-pods 216A, 216B, 218A, 218B in later descriptions, components of the front left sub-pod 216A will be referred to as "front left" components, components of the rear left sub-pod 216B will be referred to as "rear left" components, components of the front right sub-pod 218A will be referred to as "front right" components, and components of the rear right sub-pod 218B will be referred to as "rear left" components.

The sub-pod 216A has a hull 256 and a top 258 disposed on top of the hull 256. The hull 256 and the top 258 are connected to each other such that a seal is formed between the two to prevent the entry of water inside the sub-pod 216A. In some implementations, the space defined between the hull 256 and the top 258 is filled partially or completely with a low density material such as closed-cell foam. As a result, the sub-pod 216A will not fill up with water should the hull 256 or the top 258 be punctured or should the sealed connection between the hull 256 and the top 258 fail. The hull 256 and the top 258 can be made by a plastic injection molding process or by a composite material laying or spraying process. In another implementation, the hull 256 and the top 258 are integrally formed. This can be achieved by a blow-molding or a rotomolding process for example. In many of the contemplated implementations, the hull 256 is discretely molded such that it is made of a single part, thereby reducing the likelihood of water intrusion. In the present implementation, sub-pod 216A is symmetrical about a longitudinally extending vertical center plane of the pod 268 (i.e. a plane extending through the keel 264 described below). It is contemplated that the left and right sides of the sub-pod 216A could differ cosmetically and/or aesthetically and/or by minor structural difference, such as the addition of apertures to mount a bracket on one side but not on the other, in which case it is referred to herein as being substantially symmetrical. It is also contemplated that the sub-pod 216A could not be symmetrical.

The hull 256 has a bow 260, a transom 262, and a keel 264. The hull 256 also defines a pair of reverse chines 266. The reverse chines 266 help reduce water spray during operation of the watercraft 210, facilitate lift during acceleration and improve stability at rest. It is contemplated that both reverse chines 266 or that the laterally inward reverse chine 266 (i.e. the right reverse chine on the front left sub-pod 216A) could be omitted. The hull 256 is symmetrical about the vertical plane 268 passing through the keel 264. It is contemplated that the hull 256 could be asymmetric about the vertical plane passing through the keel 264.

Figure 32:
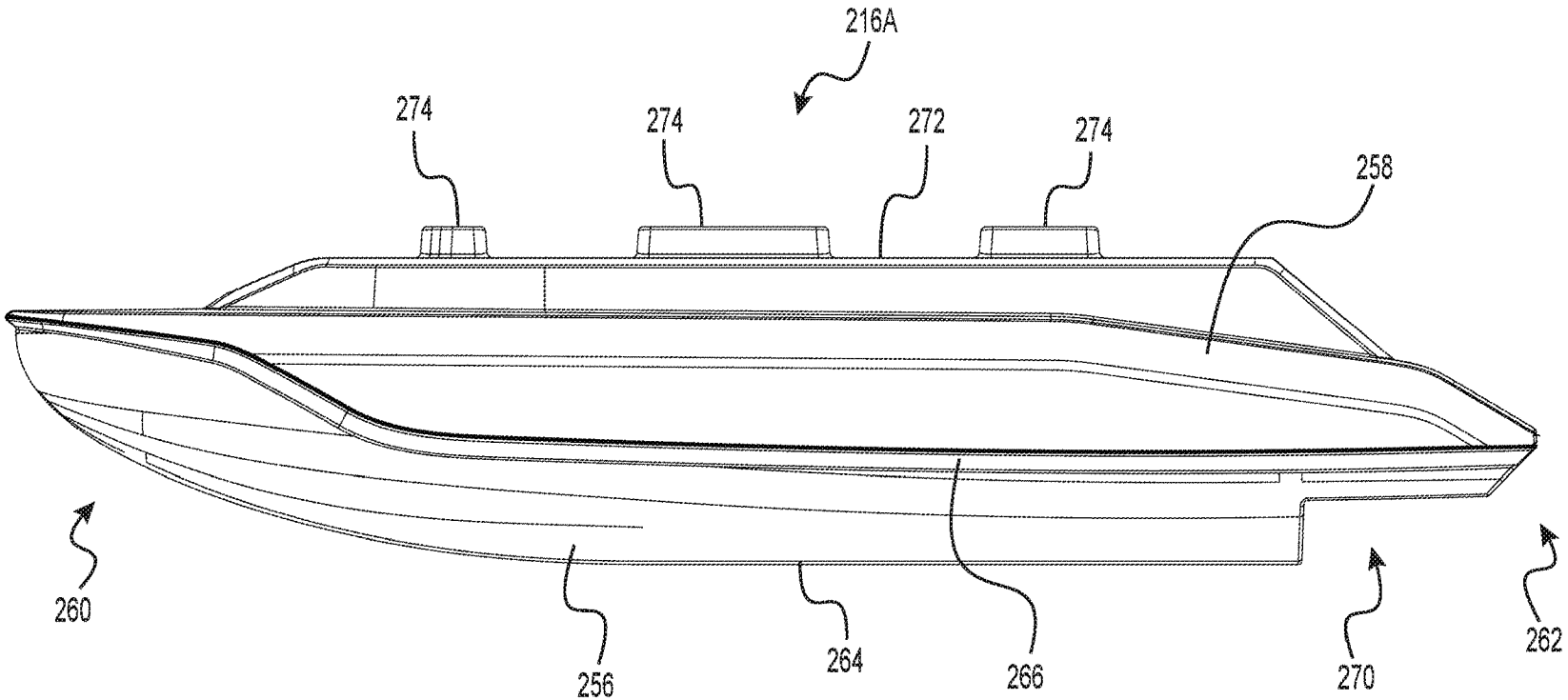
FIG. 32 is a left side elevation view of a side sub-pod of the watercraft of FIG. 19.
Figure 33:
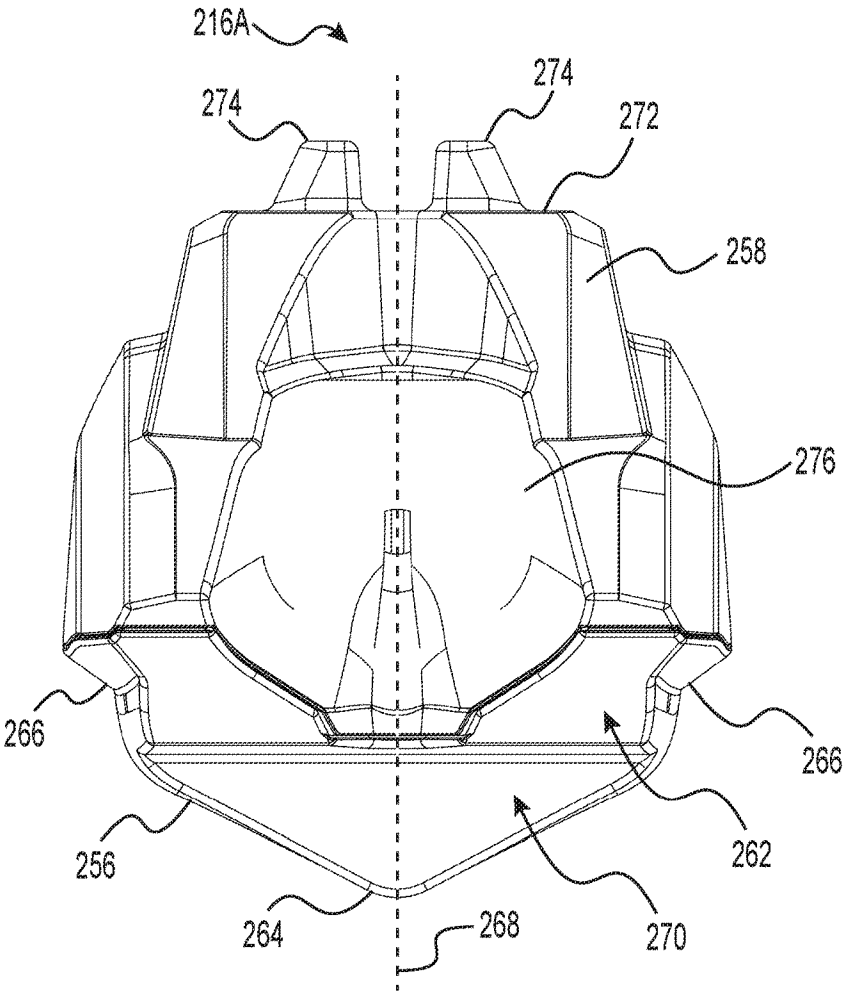
FIG. 33 is a rear elevation view thereof.
Figure 34:
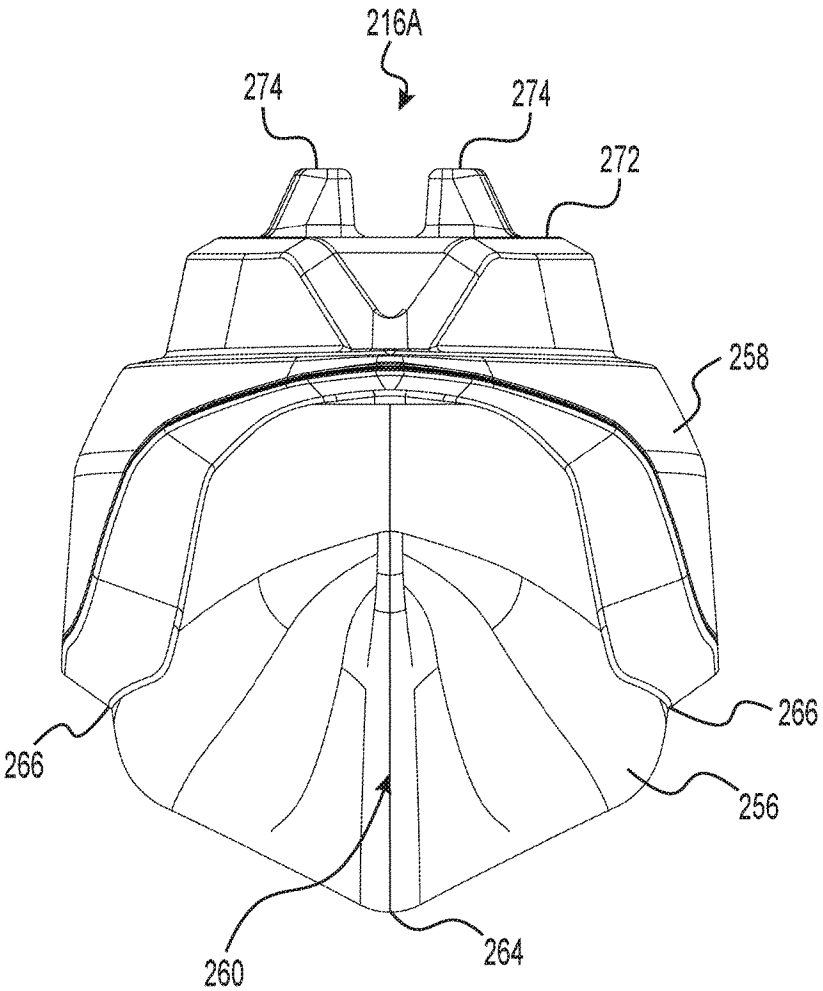
FIG. 34 is a front elevation view thereof.
Figure 35:
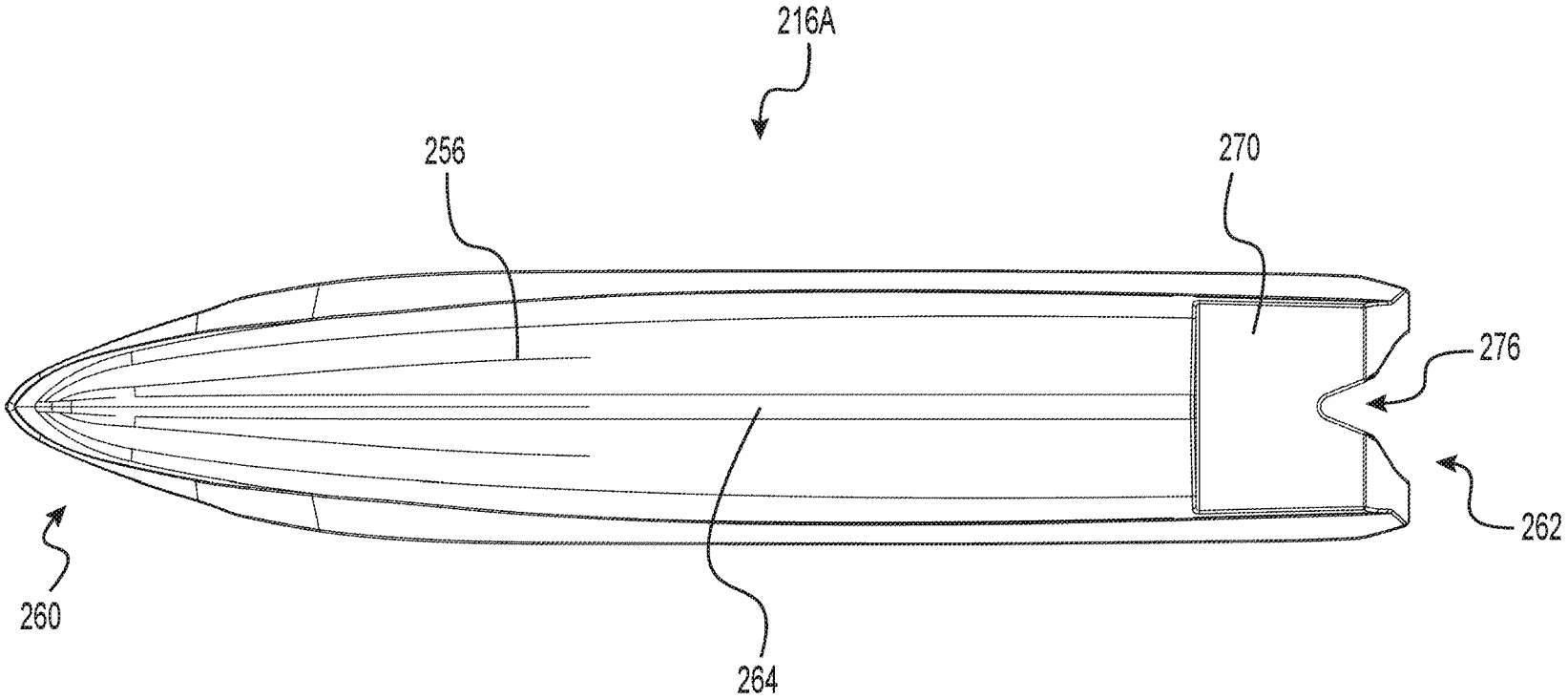
FIG. 35 is a bottom plan view thereof.

As can be seen in FIG. 35, the hull 256 tapers as it extends from the transom 262 to the bow 260. As can also be seen in FIG. 35, the hull 256 is long and narrow. In one implementation, the length-to-beam ratio of the hull 56 is about 5.2. The hull 256 is a slightly longer than half the length of the deck 212. As can be seen in FIG. 32, the bow 260 is arcuate and extends upward as it extends forward. The portion of the hull 256 disposed forward of the transom 262 defines a step 270. The transom 262 extends upward as it extends rearward.

Figure 36:
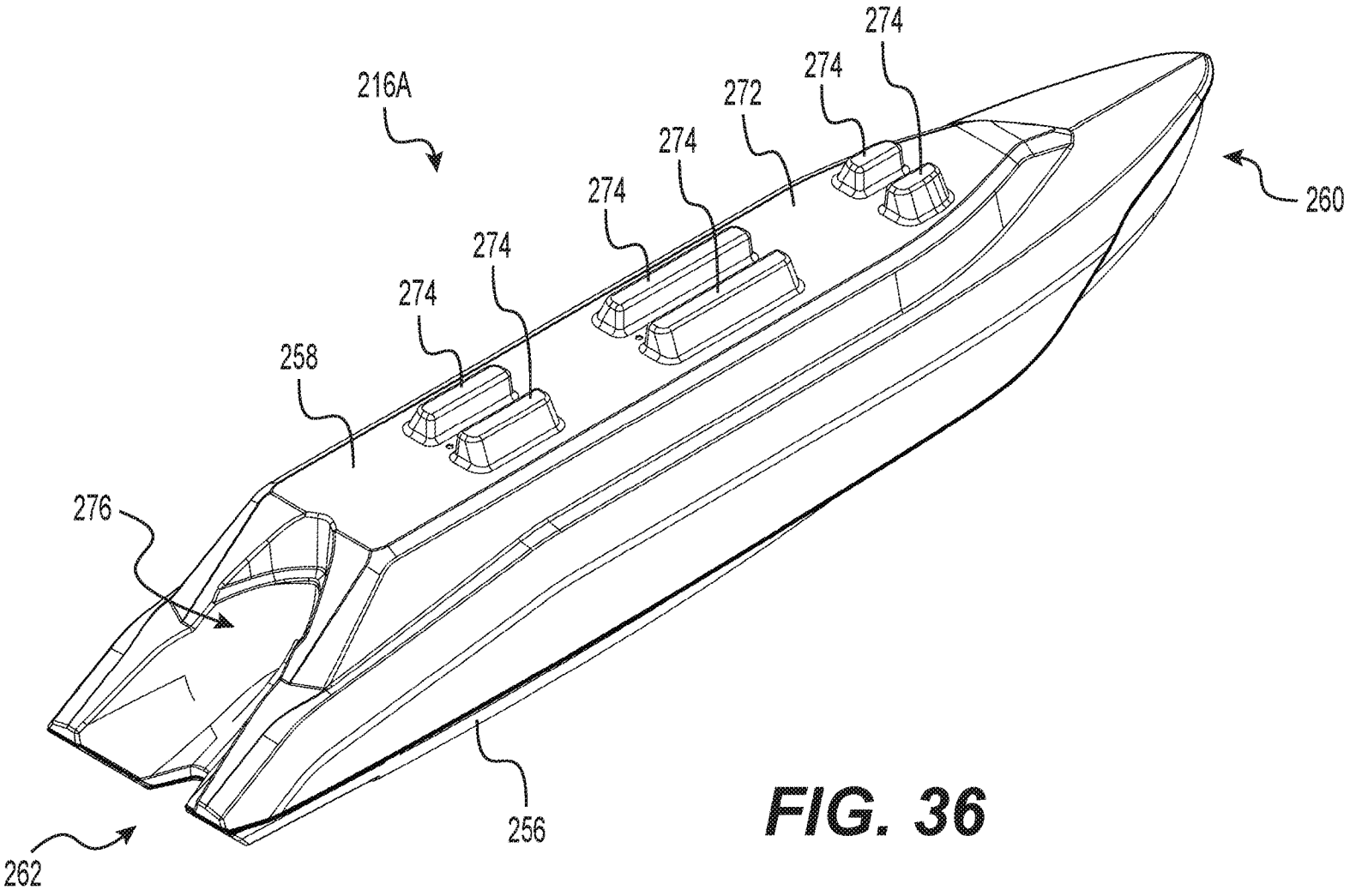
FIG. 36 is a perspective view taken from a rear, right side thereof.

As can be seen in FIG. 36, the top 258 has a generally flat central section 272 from which six legs 274 protrude upwardly. The space between the legs 274 receive ribs 219 of the deck 212 therein for fastening the sub-pod 216A to the deck 212.

As best seen in FIG. 36, the transom of the sub-pod 216A defines a notch 276. The notch 276 extends vertically through both the hull 256 and the top 258 of the sub-pod 216A and extends forwardly into the sub-pod 216A. As seen in FIG. 35, as seen from below, the notch 276 is generally V-shaped. The notch 276 has a shape that is complementary to the shape of the bow 260 of the sub-pod 216B.

For the rear sub-pods 216B, 218B, the notch 276 reduces the contact area of the hulls 256 with the water, thereby reducing the resistance to the watercraft 210 pitching up during acceleration. As a result, the notches 276 in the rear sub-pods 216B, 218B make it easier for the watercraft 210 to get on plane. It is contemplated that the notches 276 could be omitted from the rear sub-pods 216B, 218B.

The notches 276 in the front sub-pods 216A, 218A serve a different purpose. As best seen in FIGS. 22 and 25, when the sub-pods 216A, 216B, 218A, 218B are connected to the deck 212 as described above, the front portions of the bows 260 of the rear sub-pods 216B, 218B are received in the notches 276 of their corresponding front sub-pods 216A, 218A.

As can also be seen in FIG. 25, when the sub-pods 216A, 216B, 218A, 218B are connected to the deck 212, the sub-pod 216A is laterally aligned with the sub-pod 216B and the sub-pod 218A is laterally aligned with the sub-pod 218B. As such, a hull of the left pod 216 is made of the front left hull 256 of the front left sub-pod 216A and the rear left hull 256 of the rear left sub-pod 216B. Similarly, a hull of the right pod 218 is made of the front right hull 256 of the front right sub-pod 218A and the rear right hull 256 of the rear right sub-pod 218B. With reference to FIG. 24, in the present implementation, the distance between the left and right planes 268 (i.e. the keel-to-keel distance of the pods 216, 218) is 1.8 meters (5.9 feet), but it is contemplated that it could be more or less. As can be seen in FIGS. 23 and 25, a bar 278 is connected laterally between the front left and front right sub-pods 216A, 218A. It is contemplated that the bar 278 could be omitted.

As can be seen in FIG. 22 for the sub-pods 216A, 216B, when the sub-pods 216A, 216B, 218A, 218B are connected to the deck 212, lines 280A, 280B that extend along the rear portions of the keels 264 of the front left hull 256 and the rear left hull 256 are parallel to the deck 212. The lines 280A, 280 are coaxial in the present implementation.

Figure 38:
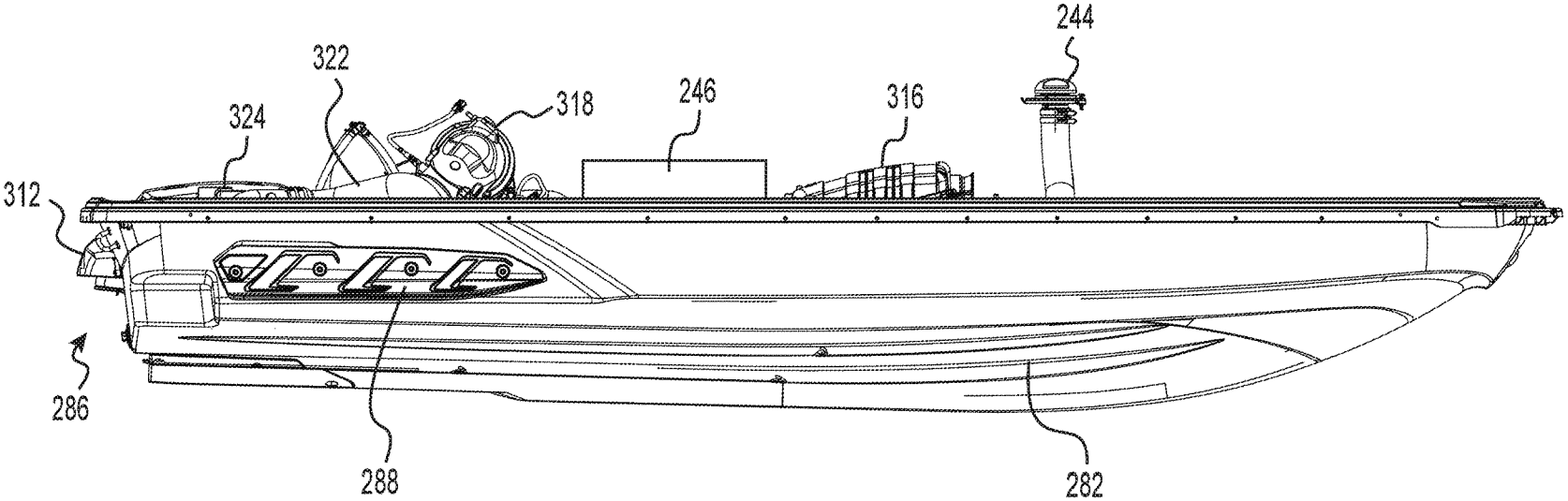
FIG. 38 is a right side elevation view of the central pod of FIG. 37, without the cap.

Turning now to FIGS. 37 to 39, the central pod 214 will be described in more detail. The central pod 214 has a central hull 282, a cap 284, the engine 246 and its associated components (described in more detail below) and a jet propulsion system 286.

The central hull 282 is identical to the central hull 86 described above, but is provided with sponsons 288 on the rear lateral sides thereof. It is contemplated that the sponsons 288 could be omitted. As such, the central hull 282 will not be described in detail herein.

The width of the central hull 282 is slightly more than half the width of the deck 212, and is greater than the combined width of the two side pods 16, 18. An internal volume of the central hull 282 (without any components inside of it) is greater than the combined internal volume of the four sub-pods 216A, 216B, 218A, 218B. As can be seen in FIG. 24, the transom deadrise angle 290 of the central hull 86 taken along location C (FIG. 22) is less than the transom deadrise angles 292 taken at the front of the steps 270 of the rear sub-pods 216B, 218B and therefore of the side pods 216, 218.

The cap 284 is used to connect the central hull 282 to the bottom of the deck 212 and to prevent the entry of water into the central hull 282. With reference to FIG. 37, the cap 284 has a top 294 and side walls that define a collar 296. The top 294 of the cap 284 defines the previously mentioned raised portions 232, 238, 248 and raised portions 298, 300 at a front and rear thereof respectively. As previously mentioned, the trap doors 234, 240 are provided in the raised portions 232, 238 respectively and the fuel cap 244 is provided on top of the raised portion 248. The raised portions 232, 238, 248, 298, 300 define laterally extending recesses 302 inside which four of the laterally extending metal ribs 219 of the deck 212 are received to connect the cap 284, and therefore the central pod 214, to the deck 212. The top 294 of the cap 284 also defines two longitudinally extending recesses 304. The raised portions 232, 238, 248, 298, 300 are disposed laterally between the recesses 304. Two of the longitudinally extending metal ribs 219 of the deck 212 are received in the recesses 304 to connect the cap 284, and therefore the central pod 214, to the deck 212. The cap 284 also has two front tabs 306. As best seen in FIGS. 23, 25, and 28 to 31, a frame structure 308 connects the front tabs 306, and therefore the central pod 214, to the metal ribs 219 of the deck 212 at locations forward of the central pod 214.

The height of the collar 296 of the cap 284 determines the vertical position of the central hull 282 with respect to the deck 212. As can be seen in FIG. 23, the distance between the central hull 212 and the bottom of the deck 212 is selected such that the central keel of the central hull 282 is lower than the keels 264 of the side pods 216, 218. In some implementations, with reference to FIG. 22, the height of the collar 296 is selected such that the vertical distance D between the line 280A that extend along the rear portion of the keel 264 of the front left hull 256 and the keel of the central hull 282 in a vertical plane passing trough location A (corresponding to the point of the keel of the central hull 282 that is furthest from the bottom surface of the deck 212) is between about ⅛ and 5/16 of the vertical distance E between the line 280A and the bottom surface of the deck 212 in the vertical plane passing through location A. Also, as shown in FIG. 24, the vertical position of the hull 282 and the transom deadrise angle 290 of the central hull 282 are selected such that a line 310 extending from the keel of the central hull 282 at the transom deadrise angle 290 of the central hull 282 intersect the vertical planes 268 passing through the keel 264 of the side pod 218 at a point vertically between the top and the keel 264 of the pod 218. Although not shown, a line that is a mirror image of the line 310 could be drawn that intersect the vertical planes 268 passing through the keel 264 of the side pod 216 at a point vertically between the top and the keel 264 of the pod 216. In some implementations, the height of the collar 296 is selected such that the greatest vertical distance between the keel of the central hull 282 and the bottom surface of the deck 212 (i.e. the sum of distances D and E in FIG. 22) is between about 30% and 40% of the lateral distance between the two keels 264 of the front left and right hulls 256 of the front left and right sub-pods 216A, 218A. Also, as will be described below, some of the components of the central pod 214, such as the engine 246, extend above the top edge of the central hull 282 as can be seen in FIG. 38. The height of the collar 296 is also selected such that such components are vertically below the bottom of the deck 212.

As best seen in FIG. 25, the cap 284 connects the central hull 282 to the deck 212 at a position that is laterally centered with respect to the deck 212 between the side pods 216, 218. The deck 212 extends forward and rearward of the central pod 214, but the central pod 214 is disposed closer to the rear of the deck 212 than the front of the deck 212. The stern of the central pod 214 is located forward of the stern of the rear side sub-pods 216B, 218B. The front of the central pod 214 is located rearward of the front of the front side sub-pods 216A, 218A but forward of the stern of the front side sub-pods 216A, 218A. With reference to FIG. 25, the front of the central pod 214 is at a distance X from the fronts of the side pods 216, 218. In the present implementation, the distance X is about 25% of the length of the deck 212. More specifically, in the present implementation, the distance X is 1.1 meter (3.6 feet). It is contemplated that the distance X could be longer or shorter. It is contemplated that in some implementations, the distance X could be between 20% and 30% of the length of the deck 212.

The jet propulsion system 286 is similar to the jet propulsion system 90 described above, but is provided with a reverse gate 312. The jet propulsion system 286 is mounted to the hull 282 in a manner similar to the manner in which the jet propulsion system 90 is mounted to the hull 86. Accordingly, the jet propulsion system 286 and the manner in which it is mounted to the hull 282 will not be described herein. It is contemplated that the reverse gate 312 could be omitted.

As can be seen in FIG. 39, the engine 246 is connected in the central hull 282 at a position forward of the jet propulsion system 286 and rearward of a fuel tank 314. As can be seen in FIG. 38, the top of the engine 246 is disposed above the top edge of the central hull 282. The trap door 234 is aligned with the engine 246. The fuel tank 314 supplies fuel to the fuel injection system (not shown) of the engine 246. It is contemplated that the fuel injection system could be replaced by a carburetor. The top of the fuel tank 314 is disposed below the top edge of the central hull 282. A fuel filler neck 315 extends from the fuel tank 314, through an aperture (not shown) in a top 294 of the cap 284. The fuel cap 244 closes the opened end of the fuel filler neck 315. An air box 316 is disposed on top of and connected to the fuel tank 314 forward of the engine 246. The air box 316 supplies air to the engine 46. The top of the air box 316 is disposed above the top edge of the central hull 282 as can be seen in FIG. 38. It is contemplated that the air box 316 could alternatively be connected to the engine 246 or the central hull 282. It is contemplated that the air box 316 could be omitted and replaced by an air filter connected to an inlet of a throttle body (not shown) of the engine 246. The exhaust gases generated by the engine 246 flow from the engine 246 through a conduit 318, then through a muffler 320, and then through a conduit 322 into the tunnel of the hull 282. A resonator 324 is connected to the conduit 322. The conduits 318, 322 and the resonator 324 extend above the top edge of the central hull 282. In the present implementation, the engine 246 is a four-stroke, fuel injected, three-cylinder, inline, internal combustion engine. It is contemplated that other types of engines could be used, such as a two-stroke, carbureted, two-cylinder, V-type, internal combustion engine. It is also contemplated that the engine 246 could be replaced by another type of motor. For example, the internal combustion engine 246 could be replaced by an electric motor, in which case the fuel tank 314, the air box 316 and the exhaust system components 318, 320, 322, 324 would be omitted and replaced by a battery pack to power the electric motor. The central pod 214 is provided with other components for the proper operation of the engine 246 such as a battery, a starter motor, ventilation hoses, and bilge pumps, but these will not be described in detail herein. It should be understood that these are nonetheless present.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A watercraft comprising:

a deck;

a central pod connected to a bottom of the deck, the central pod being laterally centered relative to the deck, the central pod comprising:

a central hull defining a central tunnel, the central tunnel having two side walls and a top wall, the central hull having a central keel;

a motor connected to the central hull and disposed at least in part in the central hull; and a jet propulsion system operatively connected to the motor, at least a portion of the jet propulsion system being disposed in the central tunnel, the jet propulsion system having a steerable nozzle;

a left pod connected to the bottom of the deck, the left pod being disposed at a left of the central pod and being laterally spaced from the central pod, the left pod comprising a left hull, the left hull being narrower than the central hull, the left hull having a left keel;

a right pod connected to the bottom of the deck, the right pod being disposed at a right of the central pod and being laterally spaced from the central pod, the right pod comprising a right hull, the right hull being narrower than the central hull, the right hull having a right keel; and a helm assembly disposed on the deck and being operatively connected to the steerable nozzle, the central keel being lower than the left and right keels, a first line extending left from the central keel at a transom deadrise angle of the central hull intersects a left vertical plane containing the left keel at a point vertically above the left keel and vertically below a top of the left pod, and a second line extending right from the central keel at the transom deadrise angle of the central hull intersects a right vertical plane containing the right keel at a point vertically above the right keel and vertically below a top of the right pod.

2. The watercraft of claim 1, wherein the motor is an engine; and the central pod further comprises a fuel tank connected to the central hull and disposed at least in part in the central hull, the fuel tank being fluidly connected to the engine.

3. The watercraft of claim 1, wherein:

the central pod further comprises a collar extending between a top edge of the central hull and the bottom of the deck; and a top of the motor is disposed above the top edge of the central hull and below the bottom of the deck.

4. The watercraft of claim 1, wherein at least a majority of a top surface of the deck is defined by a flat surface.

5. The watercraft of claim 1, wherein:

a stern of the central hull is disposed forward of a stern of the left pod and of a stern of the right pod; and a bow of the central hull is disposed rearward of a bow of the left pod and of a bow of the right pod.

6. The watercraft of claim 5, wherein:

the deck extends forward of the bows of the central, left and right pods; and the deck extends rearward of the stern of the central pod.

7. The watercraft of claim 6, wherein the deck extends rearward of the sterns of the left and right hulls.

8. The watercraft of claim 1, wherein:

a transom deadrise angle of the central hull is smaller than a transom deadrise angle of the left hull;

the transom deadrise angle of the central hull is smaller than a transom deadrise angle of the right hull; and the transom deadrise angles of the left and right hulls are equal.

9. The watercraft of claim 1, wherein a width of the central pod is greater than a combined width of the left and right pods.

10. The watercraft of claim 1, wherein:

a right side of the left pod, a left side of the central pod and a portion of the bottom of the deck disposed laterally between the left and central pods define a left channel, the left channel extending along an entire length of the central pod; and a left side of the right pod, a right side of the central pod and another portion of the bottom of the deck disposed laterally between the right and central pods define a right channel, the right channel extending along an entire length of the central pod.

11. The watercraft of claim 10, wherein:

the left pod defines at least in part a left passage fluidly communicating the left channel with a left side of the left pod; and the right pod defines at least in part a right passage fluidly communicating the right channel with a right side of the right pod.

12. The watercraft of claim 1, wherein:

the left pod comprises:

a front left sub-pod having a front left hull; and a rear left sub-pod having a rear left hull, the rear left sub-pod being disposed rearward of the front left sub-pod;

wherein the front left hull and the rear left hull define the left hull; and the right pod comprises:

a front right sub-pod having a front right hull; and a rear right sub-pod having a rear right hull, the rear right sub-pod being disposed rearward of the front right sub-pod;

wherein the front right hull and the rear right hull define the right hull.

13. The watercraft of claim 12, wherein:

a bow of the front left sub-pod extends upward as the bow of the front left sub-pod extends forward;

a transom of the front left sub-pod defines a notch;

a bow of the rear left sub-pod is received at least in part in the notch of the front left sub-pod;

a bow of the front right sub-pod extends upward as the bow of the front right sub-pod extends forward;

a transom of the front right sub-pod defines a notch; and a bow of the rear right sub-pod is received at least in part in the notch of the front right sub-pod.

14. The watercraft of claim 12, wherein:

the rear left hull defines a forwardly extending notch in a rear thereof; and the rear right hull defines a forwardly extending notch in a rear thereof.

15. The watercraft of claim 12, wherein the front left, rear left, front right and rear left sub-pods are one of identical and substantially identical to each other.

16. The watercraft of claim 12, wherein:

the front left hull is discretely molded;

the rear left hull is discretely molded;

the front right hull is discretely molded;

the rear right hull is discretely molded; and the central hull is discretely molded.

17. The watercraft of claim 1, wherein the central hull is molded separately from the left and right hulls.

18. The watercraft of claim 1, wherein a volume of the central hull is greater than a combined volume of the left and right pods.

19. A watercraft comprising:

a deck;

a central pod connected to a bottom of the deck, the central pod being laterally centered relative to the deck, the central pod comprising a central hull having a central keel;

a propulsion system connected to the central pod;

a left pod connected to the bottom of the deck, the left pod being disposed at a left of the central pod and being laterally spaced from the central pod, the left pod comprising a left hull, the left hull being narrower than the central hull, the left hull having a left keel, a right side of the left pod, a left side of the central pod and a portion of the bottom of the deck disposed laterally between the left and central pods defining a left channel, the left channel extending along an entire length of the central pod;

a right pod connected to the bottom of the deck, the right pod being disposed at a right of the central pod and being laterally spaced from the central pod, the right pod comprising a right hull, the right hull being narrower than the central hull, the right hull having a right keel, a left side of the right pod, a right side of the central pod and another portion of the bottom of the deck disposed laterally between the right and central pods defining a right channel, the right channel extending along an entire length of the central pod; and a helm assembly disposed on the deck, the central keel being lower than the left and right keels, a first line extending left from the central keel at a transom deadrise angle of the central hull intersects a left vertical plane containing the left keel at a point vertically above the left keel and vertically below a top of the left pod, and a second line extending right from the central keel at the transom deadrise angle of the central hull intersects a right vertical plane containing the right keel at a point vertically above the right keel and vertically below a top of the right pod.

* * * * *